US011729557B2

(12) United States Patent
Petersen et al.

(10) Patent No.: US 11,729,557 B2
(45) Date of Patent: Aug. 15, 2023

(54) HEARING DEVICE COMPRISING A MICROPHONE ADAPTED TO BE LOCATED AT OR IN THE EAR CANAL OF A USER

(71) Applicant: Oticon A/S, Smørum (DK)

(72) Inventors: Svend Oscar Petersen, Smørum (DK); Michael Syskind Pedersen, Smørum (DK); Anders Thule, Smørum (DK)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 17/961,974

(22) Filed: Oct. 7, 2022

(65) Prior Publication Data

US 2023/0035448 A1 Feb. 2, 2023

Related U.S. Application Data

(60) Continuation of application No. 16/909,390, filed on Jun. 23, 2020, now Pat. No. 11,510,017, which is a division of application No. 16/235,451, filed on Dec. 28, 2018, now Pat. No. 10,771,905.

(30) Foreign Application Priority Data

Dec. 29, 2017 (EP) ..... 17211236

(51) Int. Cl.
*H04R 25/00* (2006.01)

(52) U.S. Cl.
CPC ..... *H04R 25/453* (2013.01); *H04R 25/407* (2013.01); *H04R 25/505* (2013.01); *H04R 25/405* (2013.01); *H04R 2225/025* (2013.01); *H04R 2225/0213* (2019.05); *H04R 2225/43* (2013.01); *H04R 2410/01* (2013.01); *H04R 2460/13* (2013.01)

(58) Field of Classification Search
CPC ..... H04R 2225/0213; H04R 2225/025; H04R 2225/43; H04R 2410/01; H04R 2460/13; H04R 25/405; H04R 25/407; H04R 25/453; H04R 25/505
USPC ..... 381/318
See application file for complete search history.

(56) References Cited

U.S. PATENT DOCUMENTS

| | | | |
|---|---|---|---|
| 9,538,296 | B2 | 1/2017 | Rasmussen et al. |
| 2014/0348360 | A1 | 11/2014 | Gran |
| 2015/0341730 | A1 | 11/2015 | Pedersen et al. |
| 2017/0078805 | A1 | 3/2017 | Pedersen et al. |

(Continued)

FOREIGN PATENT DOCUMENTS

| | | | |
|---|---|---|---|
| CN | 105551224 | A | 6/2016 |
| EP | 2 701 145 | A1 | 2/2014 |
| EP | 2 843 971 | A1 | 3/2015 |

(Continued)

*Primary Examiner* — Phylesha Dabney
(74) *Attorney, Agent, or Firm* — Birch, Stewart, Kolasch & Birch, LLP

(57) ABSTRACT

A hearing device, e.g. a hearing aid, configured to be worn by a user, comprises a) two or more input transducers (e.g. microphones) wherein said two or more input transducers during use of the hearing device are arranged with a distance between them; b) a directional system comprising a directional algorithm configured to provide a directional pattern in dependence of said distance. The hearing device is configured to estimate a current value of said distance, or an equivalent acoustic delay, or beamformer weights of said directional system, thereby the directional performance can be optimized to the individual user.

12 Claims, 8 Drawing Sheets

(56) References Cited

U.S. PATENT DOCUMENTS

| | | | |
|---|---|---|---|
| 2017/0180870 | A1 | 6/2017 | Petersen et al. |
| 2017/0180878 | A1 | 6/2017 | Petersen et al. |

FOREIGN PATENT DOCUMENTS

| | | | |
|---|---|---|---|
| EP | 2 849 462 | A1 | 3/2015 |
| EP | 2 884 763 | A1 | 3/2015 |
| EP | 2 947 898 | A1 | 11/2015 |
| EP | 3 185 599 | A1 | 6/2017 |
| EP | 3 236 672 | A1 | 10/2017 |

HEARING DEVICE COMPRISING A MICROPHONE ADAPTED TO BE LOCATED AT OR IN THE EAR CANAL OF A USER

CROSS-REFERENCE TO RELATED APPLICATONS

This application is a Continuation of Ser. No. 16/909,390, filed Jun. 23, 2020, which is a Divisional of U.S. application Ser. No. 16/235,451, filed on Dec. 28, 2018 (now U.S. Pat. No. 10,771,905 issued Sep. 8, 2020), which claims priority under 35 U.S.C. § 119(a) to U.S. Application No. 17211236.9, filed in Europe on Dec. 29, 2017, all of which are hereby expressly incorporated by reference into the present application.

SUMMARY

The present application relates to hearing devices, e.g. hearing aids. The disclosure relates specifically to a receiver-in-the-ear (RITE) type hearing device comprising a microphone system comprising a multitude (two or more) of microphones, wherein at least a first one of the microphones is/are adapted to be located at or in an ear canal of a user, and at least a second one of the microphones is/are adapted to be located a distance from the first one(s), e.g. at or behind an ear (pinna) of the user (or elsewhere). The present disclosure proposes a scheme for cancelling or minimizing acoustic feedback from the receiver to the microphone system. An embodiment of the disclosure provides a hearing aid with microphone(s) (e.g. two or more microphones) located behind the ear and with signal input from a microphone located at or in the ear canal which is used for acoustical feedback attenuation.

The application furthermore relates to a method of operating a hearing device.

The application further relates to a data processing system comprising a processor and program code means for causing the processor to perform at least some of the steps of the method.

Embodiments of the disclosure may e.g. be useful in applications such as hearing aids, in particular hearing aids comprising an ITE-part adapted for being located at or in an ear canal of a user as well as a BTE-part adapted for being located behind an ear (pinna) of the user An object of an embodiment of the present application is to enable the application of an increased gain (without whistle) of a hearing device comprising a part comprising a microphone located at or in the ear canal of a user. In particular, it is an object of embodiments of the disclosure to enable an increased gain in so-called open fittings, e.g. in a hearing device comprising a part (termed the ITE-part) adapted for being located in the ear canal of a user, wherein the ITE-part does not provide a seal towards the walls of the ear canal (e.g. in that it exhibits an open structure, e.g. in that it comprises an open (e.g. dome or dome-like) structure (or an otherwise open structure with relatively low occlusion effect), to guide the placement of the ITE-part in the ear canal).

According to a first aspect of the present disclosure, it is proposed to make a near-field directional microphone system using at least two microphones; one located in the ear canal, and one located at or behind the ear. The acoustical feedback to the microphones located in the ear canal and at or behind the ear from a receiver located in the ear canal will be in the (acoustic) near-field range. This means that to achieve a near-field directional sensitivity that suppresses the feedback, the signal from the microphone located in the ear canal needs to be attenuated and delayed before adding (or subtracting) the resulting signal to (or from) the signal from the microphone(s) located at or behind the ear.

The near-field directionality of the microphone system can (in general) be achieved by multiplying weights (complex numbers) to the separate microphone signals before combining them (e.g. by addition or subtraction), e.g. to provide feedback suppression to a signal of the forward path (an audio signal based on sound from the environment and intended to be presented to the user).

The system can be combined with a traditional multi microphone, far-field directional system comprising two or more microphones adapted for being located at or behind the ear of the user (or elsewhere), so that the near-field directionality is realized between the signal from the (e.g. single) microphone located at or in the ear canal, with the outcome of the multi microphone, far-field directional signal from microphones located (e.g.) behind the ear. This ensures that it is possible to make noise suppression from incoming sound.

Tests have shown that it (for specific embodiments) is possible to reduce the acoustical feedback in the ear canal by up to 27 dB, resulting in (a potential for) an increased gain of 27 dB.

A hearing system comprising respective first and second hearing devices adapted for being located at left and right ears of a user, each hearing device comprising a microphone located at or in the ear canal with one or two (or more) microphones located elsewhere, e.g. at or behind the ear, may experience a variation of the microphone distances between microphones of a given hearing device from ear to ear (i.e. from device to device (e.g. from user to user)). In addition, such distances may also vary while wearing the hearing aid (e.g. during physical activities). This may be compensated by adjusting the weights in a near-field directionality filter, e.g. based on inputs from an online feedback path measurement component in the hearing device that constantly estimates the separate transfer functions from the speaker to the individual microphones of a given hearing device.

In an embodiment, the insertion gain that can be applied to an input signal picked up by the microphone system of a hearing device according to the present disclosure (without increased risk of feedback) can be increased by at least 10 dB compared to a hearing device without the feedback compensation signal provided by the microphone located at or in the ear canal of the user.

In a second aspect, a hearing device (e.g. a hearing aid) comprising two or more input transducers (e.g. microphones) and a directional system (e.g. a beamformer filtering unit) is provided. In order to get a good (far-field) directional performance, the directional algorithm may need to know the distance (or acoustic delay) between the two input transducers (e.g. microphones). In a hearing device where one microphone is located in or at an ear piece and the other is located elsewhere on the body, e.g. at or behind an ear, the microphone distance is influenced by how the hearing device is mounted and sits on the users' ear, as well as on the user's ear size.

A Hearing Device Comprising a (Near-Field) Beamformer Unit:

In a first aspect of the present application, an object of the application is achieved by a hearing device, e.g. a hearing aid, adapted for being arranged at least partly on a user's head or at least partly implanted in a user's head, the hearing device comprising an input unit for providing a multitude of electric input signals representing sound in an environment of the user, the input unit comprising at least one first input transducer for picking up said sound user and providing respective at least one first electric input signals, a second input transducer for picking up said sound and providing a second electric input signal, the second input transducer being located at or in an ear canal of the user;

an output unit comprising an output transducer for converting a processed electric signal representing said sound to a stimulus perceivable by said user as sound.

The hearing device further comprises, a near-field beamformer applied to said multitude of electric input signals and implementing a feedback suppression system for suppressing feedback from said output unit to said at least one first input transducer, and comprising an adaptation unit for modifying the second electric input signal in approximation of an acoustic transfer function, or an impulse response, from the second input transducer to the at least one first input transducer and providing a modified second electric input signal representative of an estimate of said feedback.

This has the advantage of allowing an increased gain to be applied to the input sound signal without a risk of feedback.

In an embodiment, the at least one first input transducer is located away from the ear canal of the user, e.g. in or at or behind pinna. The aim of the adaptation unit is to provide a matching of the at least one first and second electric input signals with respect to the acoustic (near-field) signal from the output unit (the feedback signal), so that the modified second electric signal (representing a feedback estimate at the at least one first input transducer in question) can be used to generate a feedback compensated signal (e.g. by subtraction, see e.g. FIG. 1B). In an embodiment, the transfer function from the second input transducer to the at least one first input transducer is determined in an off-line procedure, e.g. during fitting of the hearing device to the specific user. In an embodiment, the transfer function from the second input transducer to the at least one first input transducer is estimated in advance of the use of the hearing device, e.g. using an 'average head model', such as a head-and-torso simulator (e.g. Head and Torso Simulator (HATS) 4128C from Brüel & Kjær Sound & Vibration Measurement A/S). In an embodiment, the transfer function from the second input transducer to the at least one first input transducer is dynamically estimated, cf. e.g. EP2843971A1, FIG. 5*b* and corresponding description in sections [0114]-[0120] (and FIG. 1D).

The distance between the at least first input transducer and the second input transducer may vary from user to user depending on the physiognomy of the user, including the ear size. In an embodiment, the at least one first input transducer is located an (approximate) predefined distance from the second input transducer. In an embodiment, the predefined distance is larger than 20 mm, such as larger than 40 mm. In an embodiment, the predefined distance is smaller than 80 mm, such as smaller than 60 mm.

The term 'feedback from said output unit to said at least one input transducer' is in the present context taken to mean a (feedback) signal received at the at least one input transducer originating from the output transducer. The feedback signal may be represented as a time domain signal y(n) (amplitude versus time, index n) or as a frequency domain signal (e.g. represented by time-dependent frequency sub band signals, or a time-frequency representation Y(k,m) comprising a map of TF-bins (e.g. DFT-bins) each comprising real (e.g. magnitude) or complex values (e.g. representing magnitude and phase) of the signal at a particular time (index m) and frequency (index k). The 'feedback' may also be represented by an impulse response or a frequency response of the 'acoustic channel' (or acoustic propagation path) from the output transducer to the input transducer in question. Feedback is typically different for each of the input transducers in question and may be estimated individually.

The output transducer may e.g. comprise a loudspeaker or a vibrator of a bone conducting hearing device.

In an embodiment, near-field beamformer implementing the feedback suppression system is configured to provide a near-field beamformed signal having a minimum sensitivity for sound arriving from the ear drum of the user (e.g. based on at least one of said at least one electric input signals and said second electric input signal, e.g. by subtracting the modified second electric input signal from the at least one first electric input signal or a processed version thereof). Thereby a feedback corrected input signal (a near-field beamformed signal) is provide.

The adaptation unit may be configured to attenuate the level (or magnitude) of the second electric input signal corresponding to an attenuation provided by an acoustic propagation path of sound from the second to the at least one first input transducer. In an embodiment, the modified second electric input signal is an attenuated version of the second electric input signal, wherein the attenuation corresponds to the attenuation of the acoustic propagation path of sound from the second to the at least one first input transducer. In an embodiment, the attenuation of the acoustic propagation path of sound from the second to the at least one first input transducer is determined for an acoustic source in the near-field, e.g. from the output transducer of the hearing device as reflected by the ear drum and leaked through the ear canal to the second input transducer. In an embodiment, the propagation distance between the output transducer and the second input transducer is less than 0.05 m, such as less than 0.03 m, e.g. less than 0.02 m, such as less than 0.15 m. In an embodiment, the propagation distance between the second input transducer and the at least one first input transducer is less than 0.3 m, such as less than 0.1 m, such as less than 0.08 m, e.g. less than 0.05 m.

In an embodiment, the hearing device comprises a level detection unit for estimating a level of the at least one first and the second electric input signals. An attenuation of the acoustic propagation path of sound from the second to at least one the first input transducer can thereby be estimated.

The adaptation unit is configured to delay the second electric input signal corresponding to a delay of an acoustic propagation path of sound from the second to the at least one first input transducer. In an embodiment, the modified second electric input signal is a delayed version of the second electric input signal, wherein the delay corresponds to the delay of the acoustic propagation path of sound from the second to the at least one first input transducer. In an embodiment, the modified second electric input signal is an attenuated and delayed version of the second electric input signal, wherein the attenuation and delay corresponds to the attenuation and delay, respectively, of the acoustic propagation path of sound from the second to the at least one first input transducer.

In an embodiment, the hearing device comprises a delay estimation unit for estimating an acoustic delay between the second and at least one first input transducers.

The at least one first input transducer may e.g. be located at or behind an ear of the user. The at least one, e.g. first and second, input transducers is/are intended to be located at the same ear of the user. The hearing device may comprise a BTE-part adapted to be worn at or behind an ear of a user, and an ITE-part adapted to be located at or in an ear canal of the user. In an embodiment, the at least one first input transducer is located in the BTE-part. In an embodiment, the second input transducer is located in the ITE-part. The at least one first input transducer may e.g. be located in the BTE-part, while the second input transducer is located in the ITE-part.

The feedback suppression system may comprise a combination unit for combining the modified second electric input signal with the at least one first electric signal, or a signal originating therefrom. In an embodiment, the combination unit (e.g. a sum or subtraction unit) is configured to provide the enhanced, feedback corrected, signal by subtracting the modified second electric input signal from the at least one first electric input signal.

The hearing device may comprise a beamformer filtering unit providing a far-field beamformed signal based on at least two of said multitude of electric input signals or signals derived therefrom. In an embodiment, the far-field beamformed signal has a maximum sensitivity for sound arriving from a target direction relative to the user. The beamformed signal may be provided based on the at least one, e.g. first and second, electric (unmodified) input signals, optionally including the (possibly a low pass filtered) second electric signal. In an embodiment, the beamformer filtering unit is configured to provide a (far-field) beamformed signal based on the at least one first electric input signal, and optionally on said (possibly modified) second electric input signal and/or on one or more further electric input signals (e.g. from one or more further input transducers, e.g. microphones).

In an embodiment, the combination unit is configured to provide the enhanced, feedback corrected, signal by subtracting the modified second electric input signal from the (far-field) beamformed signal In an embodiment, the beamformer filtering unit is configured to provide said beamformed signal based on the at least one first electric input signal and the second electric input signal.

In an embodiment, the hearing device comprises a combination unit for combining the near-field and far-field beamformed signals to provide a resulting beamformed signal.

The hearing device may comprise at least two first input transducers located away from the ear canal of the user. In an embodiment, the BTE-part comprises two (or more) (first) input transducers. In an embodiment, the beamformer filtering unit is configured to provide said beamformed signal based on said at least two first electric input signals.

The hearing device may be configured to provide that the beamformer filtering unit receives a possibly low pass filtered version of the second electric input signal, so that the beamformed signal is based on a combination of said at least one first and said second electric input signals (cf. e.g. $IN_{BTE1}$, $IN_{BTE2}$, and (e.g. low pass filtered) $IN_{ITE}$) in FIG. 2B). The low pass filter may be configured to focus on frequencies, where feedback is expected NOT to occur, e.g. below 1.5 kHz, such as below 1 kHz, or below 500 Hz.

The hearing device may comprise a time to time-frequency conversion unit, e.g. a filter bank or a Fourier transformation unit, allowing the processing of signals in the time-frequency domain. In an embodiment, the feedback suppression system is configured to process the at least one and the second electric input signals in a number of frequency bands. In an embodiment, the adaptation unit is configured to process the second electric input signal in a number of frequency bands. In an embodiment, the adaptation unit is configured to only modify selected frequency bands in correspondence with the acoustic transfer function from the second input transducer to the at least one first input transducer. In an embodiment, the selected frequency bands are frequency bands that are estimated to be at risk of containing significant feedback, e.g. at risk of generating howl. In an embodiment, the selected frequency bands are predefined, e.g. determined in an adaptation procedure (e.g. a fitting session). In an embodiment, the selected frequency bands are dynamically determined, e.g. using a feedback detector (e.g. a tone detector). In an embodiment, other frequency bands that are not selected are left unmodified in the modified second electric input signal.

The hearing device, e.g. the feedback suppression system, such as the adaptation unit, may comprise a filter for providing a filtered, modified second electric input signal representative of an estimate of the feedback. The filter may be configured to focus on the frequencies, where feedback is known to occur. The filter may e.g. be configured to focus on at least some of the frequencies above 1 kHz. The filter may be a high pass filter configured to focus on frequencies above 1 kHz (i.e. to let signal components at frequencies above 1 kHz pass and to attenuate signal components at frequencies below 1 kHz). The filter may be a band pass filter configured to focus on frequencies in a range between 1 kHz and 8 kHz, such as between 1 kHz and 4 kHz.

The hearing device may be constituted by or comprise a hearing aid, a headset, or an active ear protection device or a combination thereof.

In an embodiment, the hearing device is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing device comprises a signal processing unit for enhancing the input signals and providing a processed output signal.

In an embodiment, the output unit is configured to provide a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the input unit comprises a wireless receiver for receiving a wireless signal comprising sound and for providing an electric input signal representing said sound. In an embodiment, the hearing device comprises a directional microphone system adapted to enhance a target acoustic source among a multitude of acoustic sources in the local environment of the user wearing the hearing device. In an embodiment, the directional system is adapted to detect (such as adaptively detect) from which direction a particular part of the microphone signal originates.

In an embodiment, the hearing device comprises an antenna and transceiver circuitry for wirelessly receiving a direct electric input signal from another device, e.g. a communication device or another hearing device. In an embodiment, the hearing device comprises a (possibly standardized) electric interface (e.g. in the form of a connector) for receiving a wired direct electric input signal from another device, e.g. a communication device or another hearing device. In an embodiment, the direct electric input signal represents or comprises an audio signal and/or a control signal and/or an information signal. In an embodiment, the hearing device comprises demodulation circuitry for demodulating the received direct electric input to provide the direct electric input signal representing an audio signal and/or a control signal e.g. for setting an operational parameter (e.g. volume) and/or a processing parameter of the hearing device. In general, a wireless link established by a transmitter and antenna and transceiver circuitry of the hearing device can be of any type. In an embodiment, the wireless link is used under power constraints, e.g. in that the hearing device is or comprises a portable (typically battery driven) device. In an embodiment, the wireless link is a link based on (non-radiative) near-field communication, e.g. an inductive link based on an inductive coupling between antenna coils of transmitter and receiver parts. In another embodiment, the wireless link is based on far-field, electromagnetic radiation. In an embodiment, the communication via the wireless link is arranged according to a specific modulation scheme, e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying), e.g. MSK (minimum shift keying), or QAM (quadrature amplitude modulation).

In an embodiment, the communication between the hearing device and the other device is in the base band (audio frequency range, e.g. between 0 and 20 kHz). Preferably, communication between the hearing device and the other device is based on some sort of modulation at frequencies above 100 kHz. Preferably, frequencies used to establish a communication link between the hearing device and the other device is below 70 GHz, e.g. located in a range from 50 MHz to 70 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device has a maximum outer dimension of the order of 0.15 m (e.g. a handheld mobile telephone). In an embodiment, the hearing device has a maximum outer dimension of the order of 0.08 m (e.g. a head set). In an embodiment, the hearing device has a maximum outer dimension of the order of 0.04 m (e.g. a hearing instrument).

In an embodiment, the hearing device is portable device, e.g. a device comprising a local energy source, e.g. a battery, e.g. a rechargeable battery.

In an embodiment, the hearing device comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at $t_n$ by a predefined number $N_b$ of bits, $N_b$ being e.g. in the range from 1 to 48 bits, e.g. 24 bits. Each audio sample is hence quantized using $N_b$ bits (resulting in $2^{Nb}$ different possible values of the audio sample). A digital sample x has a length in time of $1/f_s$, e.g. 50 μs, for $f_s$=20 kHz. In an embodiment, a number of audio samples are arranged in a time frame. In an embodiment, a time frame comprises 64 or 128 audio data samples. Other frame lengths may be used depending on the practical application.

In an embodiment, the hearing devices comprise an analogue-to-digital (AD) converter to digitize an analogue input (e.g. from an input transducer, such as a microphone) with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the (time-)frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. Typically, a sample rate $f_s$ is larger than or equal to twice the maximum frequency $f_{max}$, $f_s \geq 2f_{max}$. In an embodiment, a signal of the forward and/or analysis path of the hearing device is split into a number NI of frequency bands (e.g. of uniform width), where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively, or additionally, one or more detectors may form part of an external device in communication (e.g. wirelessly) with the hearing device. An external device may e.g. comprise another hearing device, a remote control, and audio delivery device, a telephone (e.g. a smartphone), an external sensor, etc.

In an embodiment, one or more of the number of detectors operate(s) on the full band signal (time domain). In an embodiment, one or more of the number of detectors operate(s) on band split signals ((time-) frequency domain), e.g. in a limited number of frequency bands.

In an embodiment, the number of detectors comprises a level detector for estimating a current level of a signal of the forward path. In an embodiment, the predefined criterion comprises whether the current level of a signal of the forward path is above or below a given (L-)threshold value. In an embodiment, the level detector operates on the full band signal (time domain). In an embodiment, the level detector operates on band split signals ((time-) frequency domain).

In a particular embodiment, the hearing device comprises a voice detector (VD) for estimating whether or not (or with what probability) an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only (or mainly) comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for estimating whether or not (or with what probability) a given input sound (e.g. a voice, e.g. speech) originates from the voice of the user of the system. In an embodiment, a microphone system of the hearing device is adapted to be able to differentiate between a user's own voice and another person's voice and possibly from NON-voice sounds.

In an embodiment, the number of detectors comprises a movement detector, e.g. an acceleration sensor. In an embodiment, the movement detector is configured to detect movement of the user's facial muscles and/or bones, e.g. due to speech or chewing (e.g. jaw movement) and to provide a detector signal indicative thereof.

In an embodiment, the hearing device comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic);

b) the current acoustic situation (input level, feedback, etc.), and c) the current mode or state of the user (movement, temperature, cognitive load, etc.);

d) the current mode or state of the hearing device (program selected, time elapsed since last user interaction, etc.) and/or of another device in communication with the hearing device.

In an embodiment, the hearing device comprises an acoustic (and/or mechanical) feedback suppression system. Acoustic feedback occurs because the output loudspeaker signal from an audio system providing amplification of a signal picked up by a microphone is partly returned to the microphone via an acoustic coupling through the air or other media. The part of the loudspeaker signal returned to the microphone is then re-amplified by the system before it is re-presented at the loudspeaker, and again returned to the microphone. As this cycle continues, the effect of acoustic feedback becomes audible as artifacts or even worse, howling, when the system becomes unstable. The problem appears typically when the microphone and the loudspeaker are placed closely together, as e.g. in hearing aids or other audio systems. Some other classic situations with feedback problem are telephony, public address systems, headsets, audio conference systems, etc. Adaptive feedback cancellation has the ability to track feedback path changes over time. It is based on a linear time invariant filter to estimate the feedback path but its filter weights are updated over time. The filter update may be calculated using stochastic gradient algorithms, including some form of the Least Mean Square (LMS) or the Normalized LMS (NLMS) algorithms. They both have the property to minimize the error signal in the mean square sense with the NLMS additionally normalizing the filter update with respect to the squared Euclidean norm of some reference signal.

In an embodiment, the hearing device further comprises other relevant functionality for the application in question, e.g. compression, noise reduction, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

A Hearing Device Comprising a (Far-Field) Beamformer Filtering Unit:

In a second aspect, a hearing device (e.g. a hearing aid) comprising two or more input transducers (e.g. microphones) and a directional (microphone) system (e.g. a beamformer filtering unit) is provided. In order to get a good directional performance, the directional algorithm may need to know the distance (or delay) between the two input transducers (e.g. microphones). A hearing device comprising one input transducer (e.g. a microphone) in the ear and at least one input transducer (e.g. a microphone) behind the ear (cf. e.g. setup of FIGS. 4A, 4B) and a beamformer algorithm that can optimize the directional performance on the individual users' ear is provided.

The directional microphone system is preferably designed to emphasize sound from one direction (typically frontal) and suppress sound from other directions (usually sounds from behind). The directional pattern typically has a cancellation angle (in the rear region), that is dependent of the microphone distance. In a simple way this is achieved by delaying the signal from one microphone and then subtracting the two microphone signals. The delay depends on the microphone distance and the desired direction of the cancellation angle. The microphone distance needed by the algorithm is the acoustical microphone distance seen from the external sound field.

According to the second aspect of the present disclosure, the hearing device is configured to estimate the microphone distance by measuring the phase difference of a sound signal originating from the sound outlet of the hearing device in the ear canal to the in-ear microphone and the behind the ear microphone. This can be used to calculate the acoustical microphone distance for sound originating from the ear. This distance correlates to the microphone distance for external sound fields, and can then be used to optimize the directional algorithm (e.g. a delay and sum algorithm or an MVDR algorithm) for the individual user.

The algorithm used to estimate the phase difference between the two microphone of sound originating from the sound outlet, can be a loop gain estimation algorithm, typically used to estimate the feedback path for minimizing the undesired acoustical feedback. The signal needed to estimate the loop gain could either be pure tones or broadband noise. This kind of system could also estimate the loop gain in real time, in order to adaptively compensate for varying microphone distances during wear.

Alternatively, the signal to estimate the delay difference between the two microphones can be broadband noise, or a pure tone sweep where the phase difference in the signal picked up by the microphones are determined. Alternatively, the signal can be of a ping type where the time delay is measured by the two microphones.

Use:

In an aspect, use of a hearing device as described above, in the 'detailed description of embodiments' and in the claims, is moreover provided. In an embodiment, use is provided in a system comprising audio distribution, e.g. a system comprising a microphone and a loudspeaker in sufficiently close proximity of each other to cause feedback from the loudspeaker to the microphone during operation by a user. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Method:

In an aspect, a method of operating a hearing device adapted for being arranged at least partly on a user's head or at least partly implanted in a user's head is furthermore provided. The method comprises

- providing a multitude of electric input signals representing sound, including
  - picking up a sound signal from the environment at a first location away from an ear canal of the user and providing at least one first electric input signal,
  - picking up a sound signal from the environment at a second location at or in said ear canal of the user and providing a second electric input signal,
- converting said feedback corrected signal or a processed version thereof to a stimulus perceivable by said user as sound,
- modifying the second electric input signal in approximation of an acoustic transfer function or an impulse response for sound from said ear canal to said location away from said ear canal, and providing a modified second electric input signal, and
- providing a feedback corrected signal based on said modified second electric input signal and on said at least one electric input signal, or a signal originating therefrom.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

The method may comprise providing a near-field beamformed signal having a minimum sensitivity for sound arriving from the ear drum of the user by subtracting the modified second electric input signal from the at least one first electric input signal, or a signal derived therefrom.

The method may comprise providing a far-field beamformed signal having a maximum sensitivity for sound arriving from a target sound source in the acoustic far-field.

The method may comprise adaptively determining approximation of an acoustic transfer function or an impulse response for sound from said ear canal to said location away from said ear canal.

The method may comprise adaptively estimating a far-field propagation distance for sound between the first location away from an ear canal of the user and the second location at or in said ear canal of the user. The hearing device (and/or a fitting system) may be configured to estimate the distance between the first and second input transducers (e.g. microphones) by measuring a phase difference of a sound signal originating from a sound outlet of the output transducer in the ear canal to the second input transducer and to the at least one first input transducer. Thereby an acoustical propagation distance for sound originating from the output transducer to the first and second input transducers can be estimated. This distance correlates to the 'microphone distance' for external sound fields, and can thus be used to optimize a (far-field) directional algorithm (e.g. a delay and sum algorithm or an MVDR algorithm, etc.).

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing device as described above, in the 'detailed description of embodiments', and in the claims, AND an auxiliary device is moreover provided.

In an embodiment, the hearing system is adapted to establish a communication link between the hearing device and the auxiliary device to provide that information (e.g. control and status signals, possibly audio signals) can be exchanged or forwarded from one to the other.

In an embodiment, the hearing system comprises an auxiliary device, e.g. a remote control, a smartphone, or other portable or wearable electronic device, such as a smartwatch or the like.

In an embodiment, the auxiliary device is or comprises a remote control for controlling functionality and operation of the hearing device(s). In an embodiment, the function of a remote control is implemented in a smartphone, the smartphone possibly running an APP allowing to control the functionality of the audio processing device via the smartphone (the hearing device(s) comprising an appropriate wireless interface to the smartphone, e.g. based on Bluetooth or some other standardized or proprietary scheme).

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device.

In an embodiment, the auxiliary device is or comprises another hearing device. In an embodiment, the hearing system comprises two hearing devices adapted to implement a binaural hearing system, e.g. a binaural hearing aid system.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system.

Definitions:

The 'near-field' of an acoustic source is a region close to the source where the sound pressure and acoustic particle velocity are not in phase (wave fronts are not parallel). In the near-field, acoustic intensity can vary greatly with distance (compared to the far-field). The near-field is generally taken to be limited to a distance from the source equal to about a wavelength of sound. The wavelength $\lambda$ of sound is given by $\lambda=c/f$, where c is the speed of sound in air (343 m/s, @20° C.) and f is frequency. At f=1 kHz (where significant speech components reside), e.g., the wavelength of sound is 0.343 m (i.e. 34 cm). In the acoustic 'far-field', on the other hand, wave fronts are parallel and the sound field intensity decreases by 6 dB each time the distance from the source is doubled (inverse square law).

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing devices, the output unit may comprise one or more output electrodes for providing electric signals (e.g. a multi-electrode array for electrically stimulating the cochlear nerve).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. smartphones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1A:
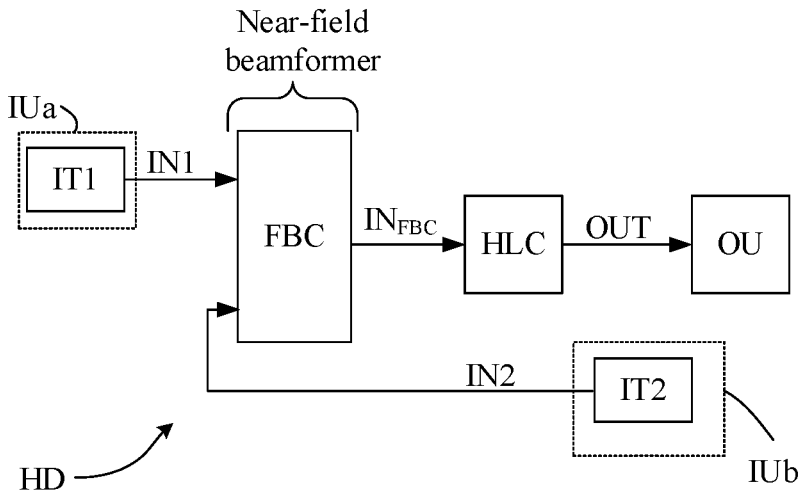
FIG. 1A schematically shows basic elements of a first embodiment of a hearing device comprising a near-field beamformer implementing a feedback suppression system according to the present disclosure.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

It is a general known problem for hearing aid users that acoustical feedback from the ear canal causes the hearing aid to whistle if the gain is too high and/or if the vent opening in the ear mould is too large. The more gain that is needed to compensate for the hearing loss, the smaller the vent (or effective vent area) must be to avoid whistle, and for severe hearing losses even the leakage between the ear mould (without any deliberate vent) and the ear canal can cause the whistling.

Hearing aids with microphones behind the ear can achieve the highest gain, due to their relatively large distance from the ear canal and vent in the mould. But for users with severe hearing loss needing high gain, it can be difficult to achieve a sufficient venting in the mould (with an acceptable howl risk).

EP2849462A1 proposes to solve the conflicting demands of good sound quality and good directionality by combining one or more supplementary microphones, e.g. located in a shell or housing of a BTE (Behind-The-Ear) hearing assistance device while introducing an audio microphone in pinna, e.g. at the entrance to the ear canal. The audio microphone is preferably the main input transducer and the signal coming from it treated according to control signals originating from the supplementary microphone(s).

EP2843971A1 deals with a hearing aid device comprising an "open fitting" providing ventilation, a receiver arranged in the ear canal, a directional microphone system comprising two microphones arranged in the ear canal at the same side of the receiver, and means for counteracting acoustic feedback on the basis of sound signals detected by the two microphones. An improved feedback reduction can thereby be achieved, while allowing a relatively large gain to be applied to the incoming signal.

FIG. 1A-1D shows four embodiments of a hearing device (HD), e.g. a hearing aid, according to the present disclosure. Each of the embodiments of a hearing device (HD) comprises a forward path between an input unit (IU; IUa, IUb) for providing a multitude of electric input signals representing sound, and an output unit (OU) for converting a processed signal to a stimulus perceivable by the user as sound. The hearing device further comprises a feedback suppression unit (FBC) for suppressing (e.g. cancelling) feedback from the output unit to the input unit and providing a feedback corrected signal $IN_{FBC}$. Each of the four embodiments of a hearing device (HD) further (optionally) comprises a signal processor (HLC) for applying one or more signal processing algorithms to a signal of the forward path (e.g. a compressive amplification algorithm for compensating for a user's hearing impairment). The feedback suppression system (FBC) may e.g. be implemented as a near-field beamformer, as indicated in FIG. 1A by reference 'Near-field beamfomer' at the feedback suppression system (FBC).

In the embodiment of FIG. 1A, the input unit (IUa, IUb) comprises a first input transducer (IT1, e.g. a microphone) for picking up a sound signal from the environment and providing a first electric input signal (IN1), and a second input transducer (IT2) for picking up a sound signal from the environment and providing a second electric input signal (IN2). The second input transducer (IT2) is adapted for being located in an ear of a user, e.g. near the entrance of an ear canal (e.g. at or in the ear canal or outside the ear canal but in the concha part of pinna). The aim of the location is to allow the second input transducer to pick up sound signals that include the cues resulting from the function of pinna (e.g. directional cues) and to allow an estimate of feedback to be provided.

The embodiment of FIG. 1A comprises two input transducers (IT1, IT2). The number of input transducers may be larger than two ((IT1, . . . , ITn), n being any size that makes sense from a signal processing point of view), and may include input transducers of a mobile device, e.g. a smartphone or even fixedly installed input transducers in communication with the hearing device.

Figure 1B:
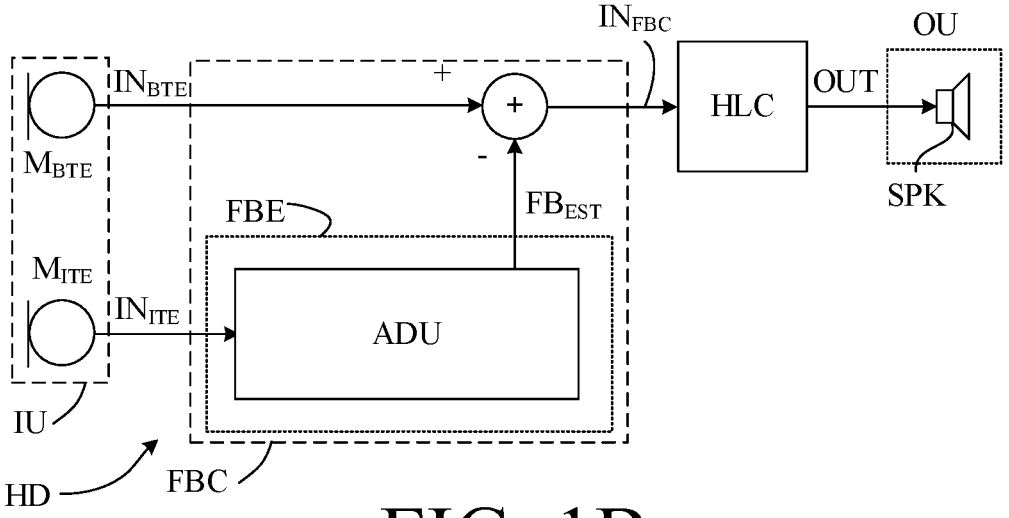
FIG. 1B schematically shows basic elements of a second embodiment of a hearing device comprising a near-field beamformer implementing a feedback suppression system according to the present disclosure.
Figure 1C:
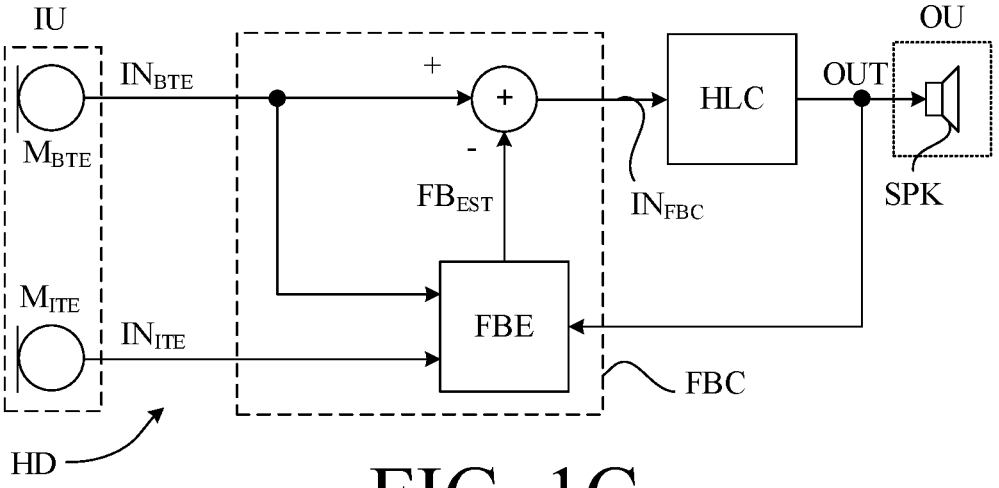
FIG. 1C schematically shows basic elements of a third embodiment of a hearing device comprising a near-field beamformer implementing a feedback suppression system according to the present disclosure.
Figure 1D:
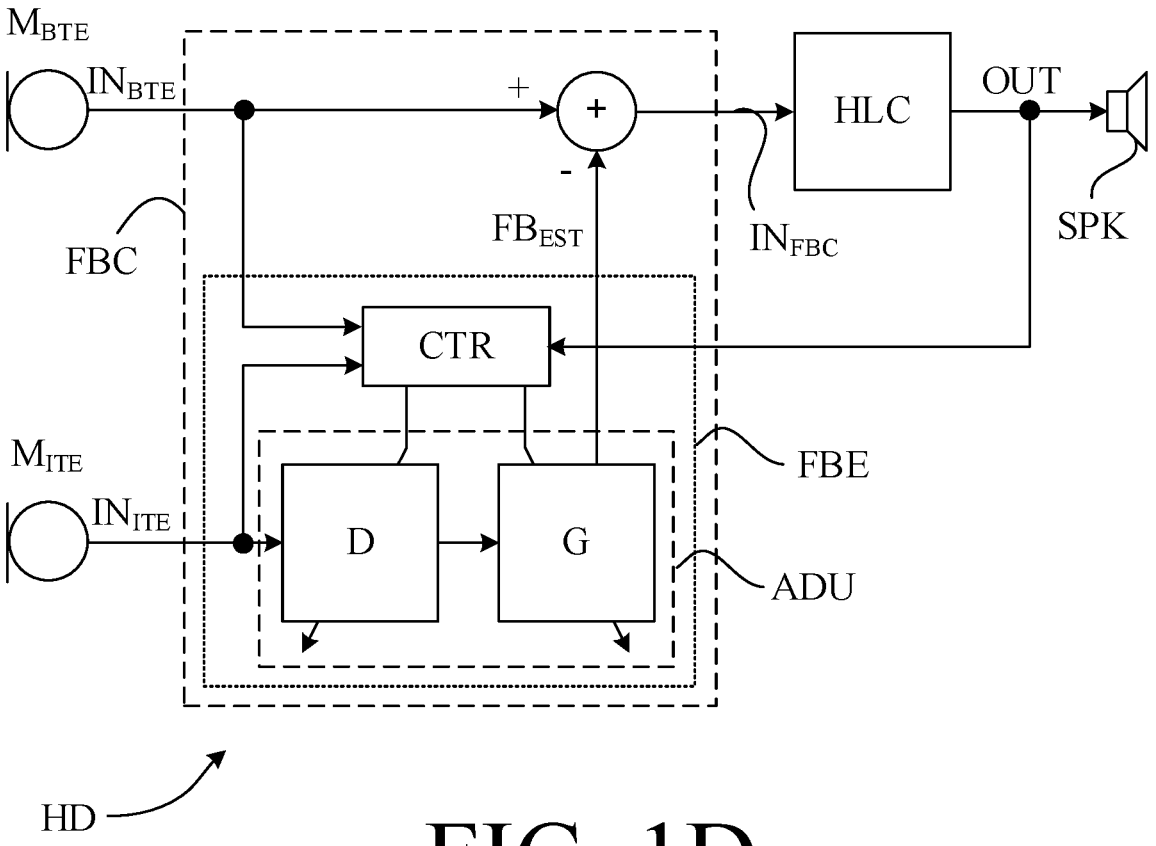
FIG. 1D schematically shows basic elements of a fourth embodiment of a hearing device comprising a near-field beamformer implementing a feedback suppression system according to the present disclosure.

The embodiments of FIGS. 1B, 1C and 1D comprise the same functional units as the embodiment of FIG. 1A (units IU (IT1, IT2), FBC, HLC, and OU). In the embodiments of FIGS. 1B, 1C and 1D, the input unit (IU) comprises first and second input transducers in the form of first and second microphones $M_{BTE}$ and $M_{ITE}$, e.g. located behind an ear and at or in an ear canal, respectively, providing first and second electric input signals $IN_{BTE}$ and $IN_{ITE}$, respectively, and the output unit (OU) comprises an output transducer in the form of a loudspeaker (SPK) for converting a processed electric output signal OUT from the processor (HLC) to an acoustic signal (e.g. vibrations in air). Alternatively, the output transducer may comprise a vibrator for delivering stimuli to bone of the head of the user (to implement a bone conducting hearing device). In the embodiments of FIGS. 1B, 1C and 1D, different embodiments of the feedback suppression unit (FBC) are schematically illustrated.

The embodiments of FIGS. 1B, 1C and 1D comprise different embodiments of the feedback suppression unit (FBC).

FIG. 1B shows an embodiment of a hearing device (HD) as shown in FIG. 1A, but where the feedback suppression unit (FBC)—indicated in the dashed enclosure—comprises a feedback estimation unit (FBE) for estimating feedback from the output unit (OU), here loudspeaker (SPK) to the input unit (here microphone $M_{BTE}$). The feedback estimation unit (FBE) comprises adjustment unit (ADU) for modifying the second electric input signal $IN_{ITE}$ in correspondence with an acoustic transfer function, or an impulse response, from the second input transducer (microphone $M_{ITE}$) to the first input transducer (microphone $M_{BTE}$) and providing a modified second electric input signal $FB_{est}$ representative of an estimate of the feedback. The feedback suppression unit (FBC) further comprises a combination unit (here sum unit '+') for combining the second electric input signal $FB_{est}$ with the first electric input signal $IN_{BTE}$ and providing a feedback corrected input signal $IN_{FBC}$ that is fed to the processor (HLC). In the embodiment of FIG. 1B, the second electric input signal representative of an estimated feedback $FB_{est}$ is subtracted from the first electric input signal $IN_{BTE}$ resulting in the feedback corrected input signal $IN_{FBC}$. The adjustment unit (ADU) may be implemented by predetermined (e.g. frequency dependent) acoustic transfer functions (or impulse responses) or adaptively determined acoustic transfer functions (or impulse responses), as e.g. indicated in FIG. 1D. The adjustment unit (ADU) may be implemented by (predetermined or adaptively determined) complex weights representing appropriate (e.g. frequency dependent) phase changes (delays) and attenuation. In an embodiment, the adaptively determined acoustic transfer functions (or impulse responses) are determined in connection with a start-up of the hearing device (typically at least once a day for a hearing aid).

FIG. 1C shows an embodiment of a hearing device (HD) as shown in FIG. 1B, but where the feedback estimation unit (FBE) additionally receives the first electric input signal $IN_{BTE}$ and the processed electric output signal OUT as inputs. Thereby an adaptive estimation of the feedback can be implemented (by adaptively estimating a transfer function from the second to the first input transducer). An example of this is illustrated in FIG. 1D.

In FIG. 1D shows an embodiment of a hearing device (HD) as shown in FIG. 1C, but where the feedback estimation unit (FBE) is further exemplified. The feedback estimation unit (FBE) (enclosed by dotted outline in FIG. 1D) providing an estimate $FB_{est}$ of the feedback from the loudspeaker (SPK) to the BTE-microphone ($M_{BTE}$) comprises adjustment unit (ADU) and control unit (CTR). The adjustment unit (ADJ) comprises delay unit (D) for applying a delay to the second electric input signal $IN_{ITE}$ corresponding to the delay of the acoustic propagation path of sound from the ITE to the BTE microphone, and gain unit (G) for applying an attenuation to the second electric input signal $IN_{ITE}$ corresponding to the attenuation of the acoustic propagation path of sound from the ITE to the BTE microphone. The control unit (CTR) is configured to adaptively control the delay and gain estimation units in dependence of the respective electric input signals $IN_{BTE}$ and $IN_{ITE}$ and the output signal (OUT) to the loudspeaker (SPK). In an embodiment, the control unit (CTR) is configured to estimate the difference in delay between the reception of a given signal from the loudspeaker at the two microphones ($M_{BTE}$ and $M_{ITE}$). A variety of methods may be applied, e.g. performing a pure tone sweep (e.g. by a generator of the processor (HLC)), where the phase difference in the signal picked up by the microphones are determined (e.g. in the control unit (CTR). The thus estimated current delay difference ($D_{BTE}$-$D_{ITE}$) can be applied to the second electric signal $IN_{ITE}$ by the delay unit (D) (controlled by the control unit (CTR)). Alternatively, the processor can be configured to issue a ping type signal, and the time difference between the arrival of the 'ping' at the two microphones ($M_{BTE}$ and $M_{ITE}$) can be determined by the control unit (CTR). In an embodiment, the control unit (CTR) comprises respective level detection units for estimating a current level ($L_{BTE}$ and $L_{ITE}$) of the first and second electric input signals ($IN_{BTE}$ and $IN_{ITE}$). A current level difference ($L_{ITE}$-$L_{BTE}$) can thus be determined and a corresponding attenuation applied to the second electric signal $IN_{ITE}$ by the gain estimation unit (G) (controlled by the control unit (CTR).

The second input transducer (IT2; $M_{ITE}$ in FIG. 1A-1D) and the output unit (OU), e.g. output transducer (OT, SPK) are e.g. located in an in-the-ear part (ITE) adapted for being located in the ear of a user, e.g. at or in the ear canal of the user, e.g. as is customary in a RITE-type hearing device. Alternatively, the second input transducer (IT2; $M_{ITE}$) may be located in concha, e.g. in the cymba-region. The processor (HLC) may be located in a separate body-worn part, e.g. in a so-called BTE-part adapted for being located at or (at least partially) behind pinna. Alternatively, the processor (HLC) may be located elsewhere, e.g. in the ITE-part (ITE) or in another part in communication with the input and output units, e.g. in a separate processing part, e.g. a smartphone or similar device. The first input transducer (IT1; $M_{BTE}$) may e.g. be located in the behind-the-ear part (BTE) or elsewhere on the head of the user, e.g. at an ear of the user.

The 'operational connections' between the functional elements of the hearing device (HD) (units IU (IT1, IT2), FBC, HLC, and OU) can be implemented in any appropriate way allowing signals to the transferred (possibly exchanged) between the elements (at least to enable a forward path from the input unit (transducers) to the output unit (transducer), via (and possibly in control of) the processor (HLC)). The different units of the hearing device may be electrically connected via wired electric connections. Alternatively, non-wired electric connections, e.g. wireless connections, e.g. based on electromagnetic signals, may be used. In such case the inclusion of relevant antenna and transceiver circuitry is implied. One or more of the wireless links may be based on Bluetooth technology (e.g. Bluetooth Low-Energy or similar technology). Thereby a relatively large bandwidth and a relatively large transmission range is provided. Alternatively or additionally, one or more of the wireless links may be based on near-field, e.g. capacitive or inductive, communication. The latter has the advantage of having a low power consumption.

The processor (HLC) is configured to process the feedback corrected signal $IN_{FBC}$ (or a processed version thereof), and for providing a processed (preferably enhanced) output signal (OUT). The processor (HLC) may comprise a number of processing algorithms, e.g. a noise reduction algorithm, for enhancing the feedback corrected (e.g. beamformed and optionally further noise reduced) signal, e.g. according to a user's needs (e.g. to compensate for a hearing impairment) to provide the processed output signal (OUT). All embodiments of a hearing device are adapted for being arranged at least partly on a user's head or at least partly implanted in a user's head (an at least partly implanted part e.g. comprising a carrier for attaching a vibrator of a bone-conduction hearing device).

Figure 2A:
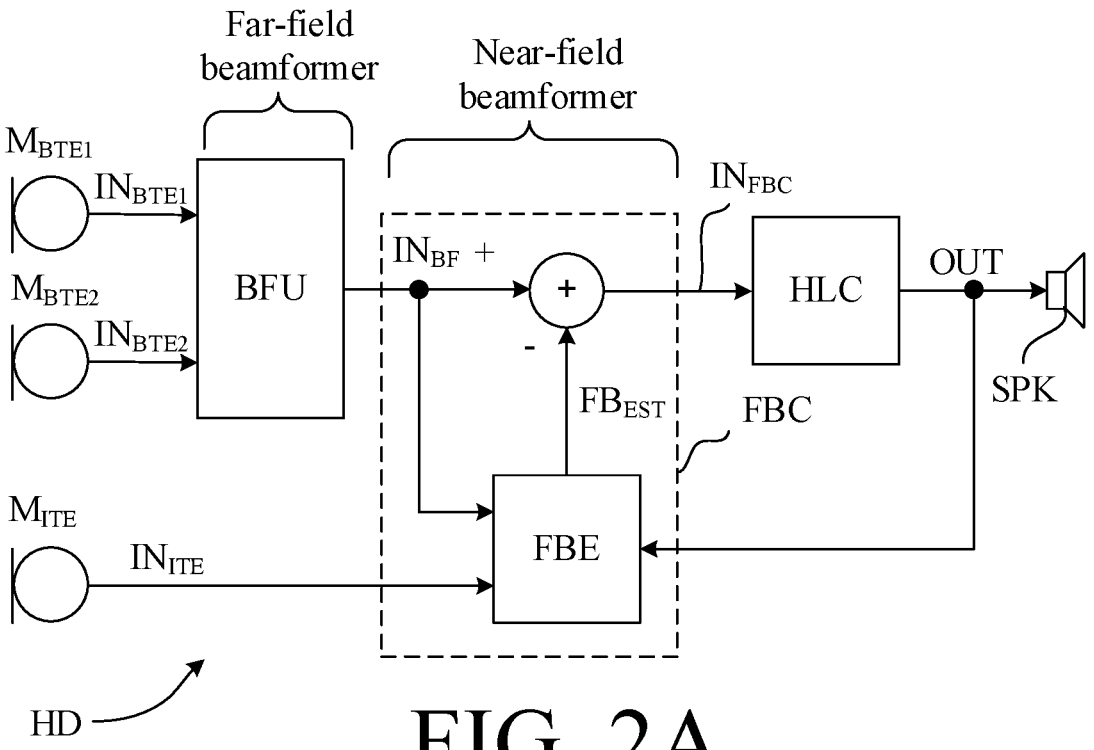
FIG. 2A schematically shows basic elements of a first embodiment of a hearing device comprising a feedback suppression system and a far-field beamformer filtering unit according to the present disclosure.
Figure 2B:
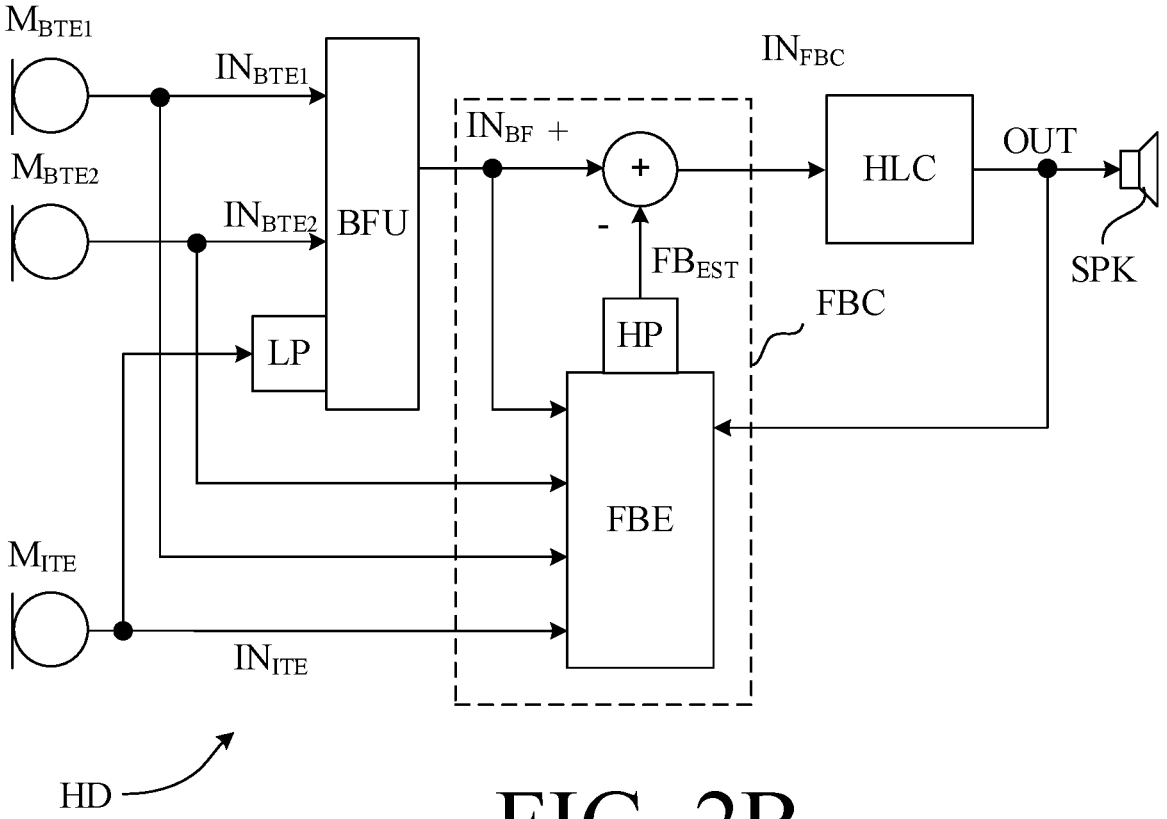
FIG. 2B schematically shows basic elements of a second embodiment of a hearing device comprising a feedback suppression system and a far-field beamformer filtering unit according to the present disclosure.

The embodiments of a hearing device (HD) of FIGS. 2A and 2B comprises the same functional elements as described in FIG. 1A-1D. A difference is that the embodiments of FIGS. 2A and 2B, each comprises three input transducers ($M_{BTE1}$, $M_{BTE2}$, $M_{ITE}$) in the form of microphones (e.g. omni-directional microphones). Each of the input transducers of the input unit can theoretically be of any kind, such as comprising a microphone (e.g. a normal microphone or a vibration sensing bone conduction microphone), or an accelerometer, or a wireless receiver. Each of the embodiments of a hearing device (HD) comprises an output unit (OU) comprising an output transducer (OT) for converting a processed output signal to a stimulus perceivable by the user as sound. In the embodiments of a hearing device (HD) of FIGS. 1B, 1C, 1D, and 2A and 2B, the output transducer is shown as receivers (loudspeakers, SPK). A receiver can e.g. be located in an ear canal (RITE-type (Receiver-In-The-ear) or a CIC (completely in the ear canal-type) hearing device) or outside the ear canal (e.g. in a BTE-type hearing device), e.g. coupled to a sound propagating element (e.g. a tube) for guiding the output sound from the receiver to the ear canal of the user (e.g. via an ear mould located at or in the ear canal). Alternatively, other output transducers can be envisioned, e.g. a vibrator of a bone anchored hearing device.

The embodiments of a hearing device (HD) of FIG. 1A-1D, and FIG. 2A-2B are shown without indication of any domain transformations of the electric input and processed signals. In general, at least a transformation from analogue to digital domain is implied (e.g. using appropriate analogue to digital converters e.g. forming part if the respective input transducers (e.g. microphones) or included as separate units. The signal processing may be performed fully or partially in the time domain. In an embodiment, the hearing device comprises appropriate time to frequency conversion units (t/f) enabling analysis and/or processing of the electric input signals ($IN_{BTE1}$, $IN_{BTE2}$, $IN_{ITE}$) from the input transducers (here microphones $M_{BTE1}$, $M_{BTE2}$, $M_{ITE}$), respectively, in the frequency domain. In the embodiments of FIGS. 2A and 2B, the time-frequency conversion units may be included in the beamforming filtering unit (BF, for signals $IN_{BTE1}$, $IN_{BTE2}$, and possibly $IN_{ITE}$) and in the feedback suppression system (FBC, for signal $IN_{ITE}$), but may alternatively form part of the respective input transducers or of the signal processor (HLC) or be separate units. The hearing device (HD) may further comprise a frequency to time conversion unit (fit), e.g. included in the signal processor (HLC) or be located elsewhere, e.g. in connection with the output unit, e.g. the output transducer (OT).

FIG. 2A shows an embodiment of a hearing device (HD) as shown in FIG. 1C. In addition, the embodiment of FIG. 2A comprises a beamformer filtering unit (BF, denoted Far-field beamformer) for providing a spatially filtered (beamformed) signal $IN_{BF}$, which is fed to the feedback suppression unit (FBC, denoted Near-field beamformer) and processed as described in FIG. 1C. The (far-field) beamformer filtering unit (BFU) is e.g. configured to maintain (or attenuate less) signal components in the sound field around the (first) microphones ($M_{BTE1}$, $M_{BTE2}$) from a direction to a current target sound source (e.g. $S_{FF}$ in FIG. 4B), while signal components from other directions are attenuated (e.g. attenuated more than signals from the target direction). The (far-field) beamformer filtering unit (BFU) may e.g. comprise a beamformer as described in FIG. 5.

FIG. 2B shows an embodiment of a hearing device (HD) as shown in FIG. 2A. In addition, the embodiment of FIG. 2B the feedback estimation unit (FBE) further receives the (first) electric input signals ($IN_{BTE1}$, $IN_{BTE2}$) from the first and second (BTE) microphones ($M_{BTE1}$, $M_{BTE2}$). The feedback estimate ($FB_{est}$) is thus dependent of all three electric input signals (($IN_{BTE1}$, $IN_{BTE2}$, $IN_{ITE}$), the beamformed signal ($IN_{BF}$) and the processed electric output signal (OUT). The resulting feedback estimate ($FB_{est}$) that is fed to the combination unit ('+') is e.g. high pass filtered (cf. indication 'HP' on the output from the feedback estimation unit (FBE)). The high pass filtering of the ITE microphone signal ($IN_{ITE}$) is intended to focus on the frequencies, where feedback is known to occur (i.e. above 1 kHz, e.g. in a range between 1 kHz and 8 kHz, such as between 1 kHz and 4 kHz). Further, the beamformer filtering unit (BFU) receives (a possibly low pass filtered version of (cf. indication 'LP' on the input to the beamformer filtering unit (BF))) the (second) electric input signal ($IN_{ITE}$), so that the beamformed signal $IN_{BF}$ is based on a combination of the three input signals ($IN_{BTE1}$, $IN_{BTE2}$, and (e.g. low pass filtered) $IN_{ITE}$)). The low pass filtering of the ITE microphone signal ($IN_{ITE}$) is intended to focus on the frequencies, where feedback is known NOT to occur.

The directional system (beamformer filtering unit BFU) may e.g. comprise a low frequency part and a high frequency part. At relatively low frequencies, e.g. below 1 kHz or below 1.5 kHz, the beamformer filtering unit relies on a combination of a signal from the ITE-microphone ($IN_{ITE}$) and one or both of the signals from the BTE microphones ($IN_{BTE1}$, $IN_{BTE2}$). At relatively high frequencies, e.g. above 1 kHz or above 1.5 kHz, the beamformer filtering unit relies only on the signals from the BTE microphones ($IN_{BTE1}$, $IN_{BTE2}$).

Figure 3:
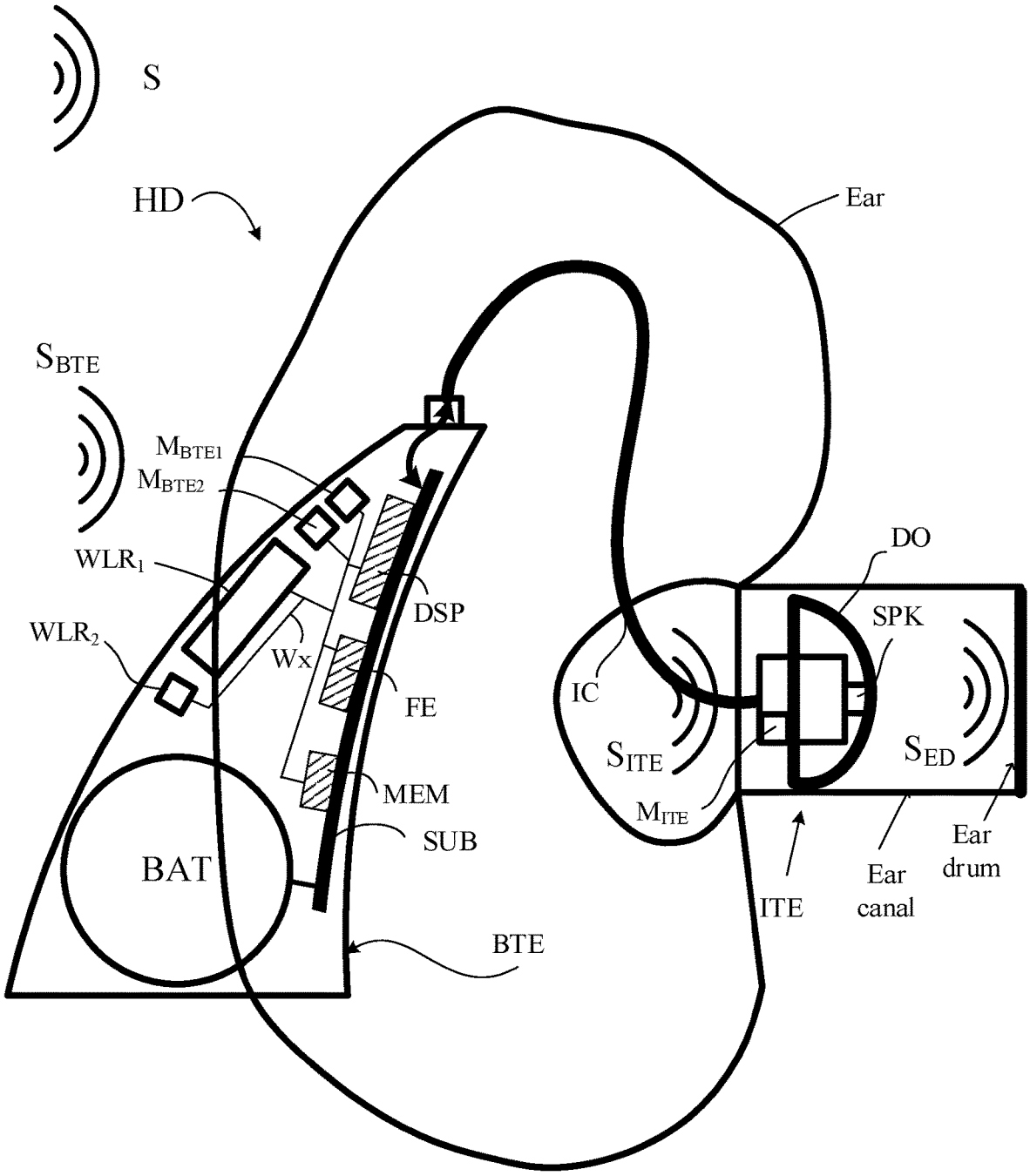
FIG. 3 shows an embodiment of a RITE-type hearing device according to the present disclosure comprising a BTE-part, an ITE-part and a connecting element.

FIG. 3 shows an embodiment of a hearing device according to the present disclosure. The hearing device (HD), e.g. a hearing aid, is of a particular style (sometimes termed receiver-in-the ear, or RITE, style) comprising a BTE-part (BTE) adapted for being located at or behind an ear of a user, and an ITE-part (ITE) adapted for being located in or at an ear canal of the user's ear and comprising a receiver (loudspeaker). The BTE-part and the ITE-part are connected (e.g. electrically connected) by a connecting element (IC) and internal wiring in the ITE- and BTE-parts (cf. e.g. wiring Wx in the BTE-part).

In the embodiment of a hearing device in FIG. 3, the BTE part comprises an input unit (IU in FIG. 1A-1C) comprising two (first) input transducers (e.g. microphones) ($M_{BTE1}$, $M_{BTE2}$), each for providing an electric input audio signal representative of an input sound signal ($S_{BTE}$) (originating from a sound field S around the hearing device). The input unit further comprises two wireless receivers ($WLR_1$, $WLR_2$) for providing respective directly received auxiliary audio and/or control input signals (and/or allowing transmission of audio and/or control signals to other devices). The hearing device (HD) comprises a substrate (SUB) whereon a number of electronic components are mounted, including a memory (MEM) e.g. storing different hearing aid programs (e.g. parameter settings defining such programs) and/or hearing aid configurations, e.g. input source combinations ($M_{BTE1}$, $M_{BTE2}$, $WLR_1$, $WLR_2$), e.g. optimized for a number of different listening situations. The substrate further comprises a configurable signal processor (DSP, e.g. a digital signal processor, including the processor (HLC), feedback suppression (FBC) and beamformers (BFU) and other digital functionality of a hearing device according to the present disclosure). The configurable signal processing unit (DSP) is adapted to access the memory (MEM) and for selecting and processing one or more of the electric input audio signals and/or one or more of the directly received auxiliary audio input signals, based on a currently selected (activated) hearing aid program/parameter setting (e.g. either automatically selected, e.g. based on one or more sensors and/or on inputs from a user interface). The mentioned functional units (as well as other components) may be partitioned in circuits and components according to the application in question (e.g. with a view to size, power consumption, analogue vs. digital processing, etc.), e.g. integrated in one or more integrated circuits, or as a combination of one or more integrated circuits and one or more separate electronic components (e.g. inductor, capacitor, etc.). The configurable signal processor (DSP) provides a processed audio signal, which is intended to be presented to a user. The substrate further comprises a front end IC (FE) for interfacing the configurable signal processor (DSP) to the input and output transducers, etc., and typically comprising interfaces between analogue and digital signals. The input and output transducers may be individual separate components, or integrated (e.g. MEMS-based) with other electronic circuitry.

The hearing device (HD) further comprises an output unit (e.g. an output transducer) providing stimuli perceivable by the user as sound based on a processed audio signal from the processor (HLC) or a signal derived therefrom. In the embodiment of a hearing device in FIG. 3, the ITE part comprises the output unit in the form of a loudspeaker (receiver) for converting an electric signal to an acoustic (air borne) signal, which (when the hearing device is mounted at an ear of the user) is directed towards the ear drum (Ear drum), where sound signal ($S_{ED}$) is provided. The ITE-part further comprises a guiding element, e.g. a dome, (DO) for guiding and positioning the ITE-part in the ear canal (Ear canal) of the user. The ITE-part further comprises an (second) input transducer, e.g. a microphone ($M_{ITE}$), for providing an electric input audio signal ($IN_{ITE}$ in FIG. 1A-D, 2A-B) representative of an input sound signal ($S_{ITE}$).

The hearing device (HD) exemplified in FIG. 3 is a portable device and further comprises a battery (BAT), e.g. a rechargeable battery, e.g. based on Li-Ion battery technology, e.g. for energizing electronic components of the BTE- and possibly ITE-parts. In an embodiment, the hearing device, e.g. a hearing aid (e.g. the processor (HLC)), is adapted to provide a frequency dependent gain and/or a level dependent compression and/or a transposition (with or without frequency compression) of one or more frequency ranges to one or more other frequency ranges, e.g. to compensate for a hearing impairment of a user.

Figure 4A:
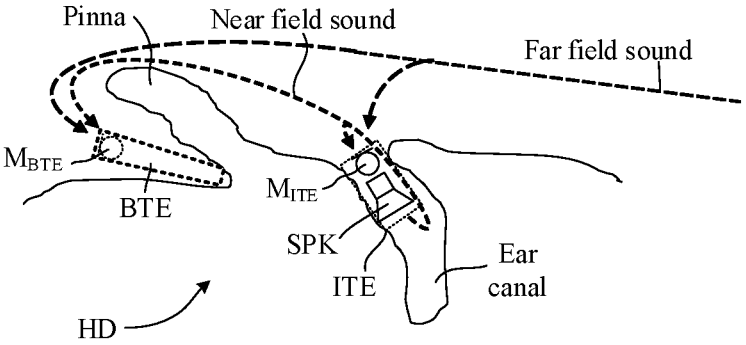
FIG. 4A shows an embodiment of a hearing device according to the present disclosure comprising a BTE-part located behind an ear (as seen from above) and comprising a microphone and an ITE-part located in the ear canals comprising microphone and a loudspeaker.

FIG. 4A shows an embodiment of a hearing aid (HD) according to the present disclosure comprising a BTE-part (BTE) located behind an ear (Pinna, as seen from above) and comprising a microphone ($M_{BTE}$) and an ITE-part (ITE) located in the ear canal (Ear canal) comprising a microphone ($M_{ITE}$) and a loudspeaker (SPK). The microphone ($M_{ITE}$) faces the environment. The loudspeaker (SPK) faces the ear drum (cf. Ear drum in FIG. 4B).

The dashed lines in FIG. 4A indicate the propagation of the external sound field approaching from the frontal direction (Far-field sound) (————) and the sound field generated by the speaker in the ear canal (Near-field sound) (- - - - -). The path length difference for sound arriving at the microphones of the hearing device originating from the far field and from the near-field, respectively, may be substantial.

The (far-field) directional microphone system is designed to emphasize sound from one direction (typically frontal) and suppress sound from other directions, (usually sounds from behind). The directional pattern typically has a cancellation angle (or more cancellation angles) in the rear region (e.g. adaptively determined) that is dependent of the microphone distance. In a simple way this may be achieved by delaying the signal from one microphone and then subtracting the two microphone signals. The delay depends on the microphone distance and the desired direction of the cancellation angle. The microphone distance needed by the algorithm is the acoustical microphone distance seen from the external sound field. Alternatively, the far-field directional system (beamformer filtering unit) may comprise a linearly constrained minimum variance (LCMV) beamformer, e.g. a minimum variance distortionless response (MVDR) beamformer.

In an embodiment, the hearing device, e.g. a hearing instrument, estimates the microphone distance by measuring the phase difference of a sound signal originating from the sound outlet of the hearing device (e.g. loudspeaker SPK in FIG. 4A) in the ear canal to the in-ear microphone ($M_{ITE}$) and the behind the ear microphone ($M_{BTE}$). This can be used to calculate the acoustical microphone distance from sound originating from the ear. This distance correlates to the microphone distance for external sound fields (cf. FIG. 4A), and can then be used to optimize the directional algorithm for the individual user.

The algorithm used to estimate the phase difference between the two microphone of sound originating from the sound outlet, can be a loop gain estimation algorithm, usually used to estimate the feedback path for minimizing the undesired acoustical feedback. The signal needed to estimate the loop gain may e.g. either be pure tones or broadband noise. This kind of system may also estimate the loop gain real time, in order to adaptively compensate for varying microphone distances during wear.

Alternatively, the signal to estimate the delay difference between the two microphones can be broadband noise, pure tone sweep where the phase difference in the signal picked up by the microphones are determined. Alternatively, the signal could be of a ping type where the time delay is measured by the two microphones.

Figure 4B:
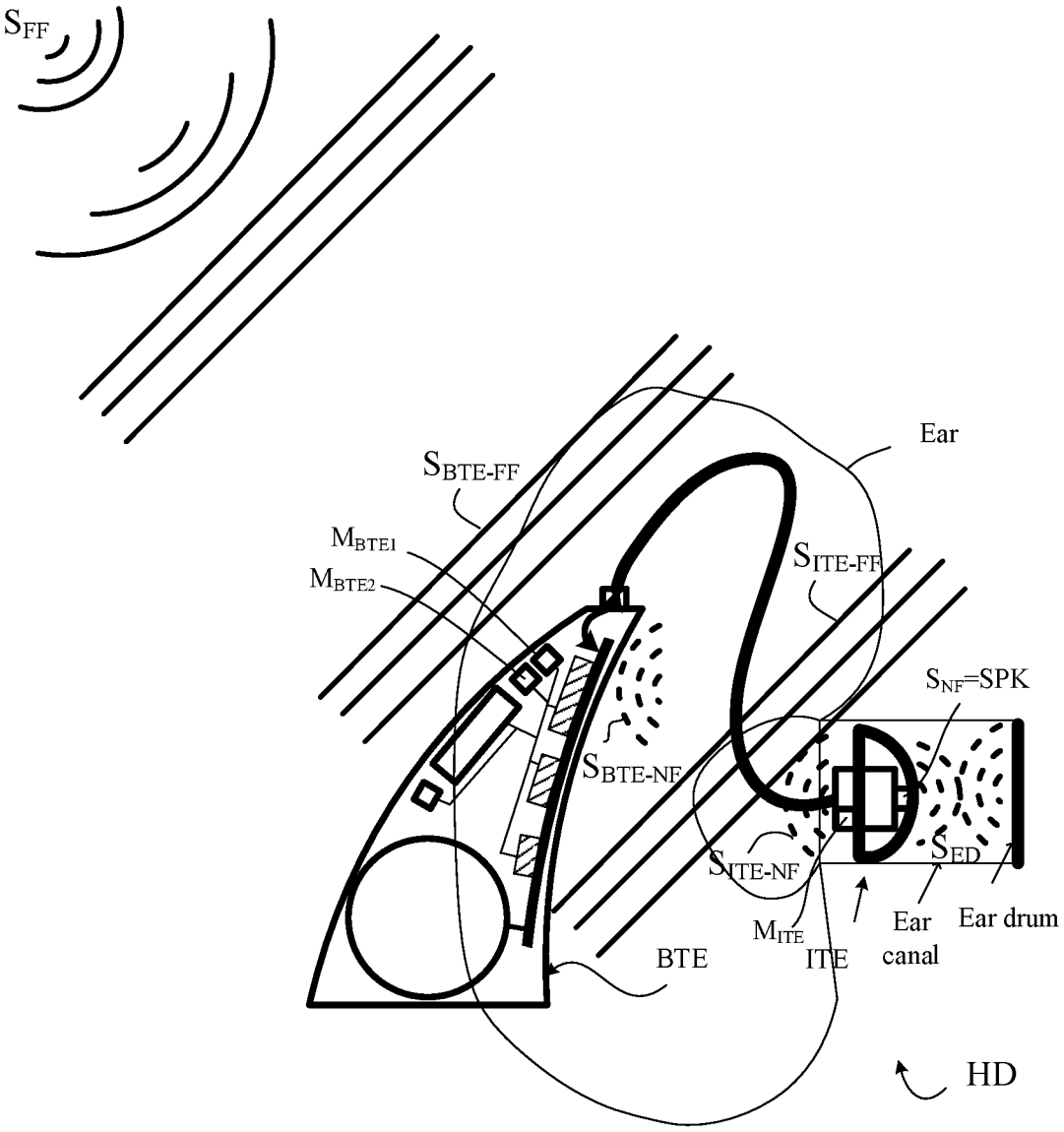
FIG. 4B illustrates a scenario comprising the hearing device of FIG. 4A located in the acoustic far-field of a relatively distant sound source and in the acoustic near-field of a relatively close sound source.

FIG. 4B schematically illustrates a scenario comprising the hearing device (HD) of FIG. 4A located in the acoustic far-field (denoted $S_{BTE-FF}$ and $S_{ITE-FF}$ at the BTE and ITE microphones, $M_{BTE1}$, $M_{BTE2}$ and $M_{ITE}$, respectively) of a relatively distant sound source ($S_{FF}$) and in the acoustic near-field (denoted $S_{BTE-NF}$ and $S_{ITE-NF}$ at the BTE and ITE microphones, respectively) of a relatively close sound source ($S_{NF}$). 'Relatively close' and 'relatively distant' is taken relative to the hearing device (microphones). In the scenario of FIG. 4B, the relatively close sound source ($S_{NF}$) originates from sound played by the loudspeaker (SPK) located in the ear canal (Ear canal) of the user. The sound $S_{ED}$ is reflected by the walls and ear drum (Ear drum) of the ear canal and propagated towards the environment arriving at the ITE-microphone ($M_{ITE}$) and later (farther away) at the first and second BTE-microphones ($M_{BTE1}$, $M_{BTE2}$). The acoustic far-field ($S_{BTE-FF}$ and $S_{ITE-FF}$ at the BTE and ITE microphones, respectively) is illustrated by straight solid lines illustrating the plane wave nature of sound waves in the far-field approximation. The acoustic near-field ($S_{BTE-NF}$ and $S_{ITE-NF}$ at the BTE and ITE microphones, respectively) is illustrated by curved dashed lines illustrating the non-parallel wave fronts of sound waves in the near-field approximation. In the near-field, acoustic intensity can vary greatly with distance, whereas in the far-filed, it has a (smaller) constant decrease (in a logarithmic representation, 6 dB each time the distance from the source is doubled). The $S_{ITE-FF}$ part of the signal picked up by $M_{ITE}$ is nearly the same as the $S_{BTE-FF}$ part of the signal from the far-field sound source, but the attenuation $G_{ITE-BTE}$ applied to the total signal picked up by the ITE-microphone by the adjustment unit (cf. e.g. FIG. 1D) is relatively large, so the (attenuated) component is insignificant compared to the $S_{BTE-FF}$ part received at the BTE-microphone(s) (i.e. $IN_{BTE-FF} >> G_{ITE-BTE} * IN_{ITE-FF}$, where $IN_{ITE} = IN_{ITE-FF} + IN_{ITE-NF}$, and $IN_{IBTE} = IN_{BTE-FF} + IN_{BTE-NF}$). Since $IN_{BTE-NF} = FB$ and $FB_{est} = G_{ITE-BTE} * IN_{ITE} = G_{ITE-BTE} * (IN_{ITE-FF} + IN_{ITE-NF})$, and $IN_{BTE-FF}$ is approximated by $IN_{BTE}$-$FB_{est}$, $IN_{BTE-FF}$ ~ $IN_{BTE}$-$G_{ITE-BTE}$*($IN_{ITE-FF}$+$IN_{ITE-NF}$). To minimize such error (improve the feedback estimate), the term $G_{ITE-BTE}$*$IN_{ITE-FF}$ may be adaptively estimated and compensated for (cf. e.g. FIGS. 6A, 6B).

The feedback path transfer functions which represent the change of the acoustical sound signal from the speaker SPK to each of the microphones ($M_{ITE}$ and $M_{BTEx}$, x=1, 2) are e.g. denoted $H_{ITE}$ and $H_{BTEx}$, respectively. The relative feedback path transfer function between the ITE and BTE microphones ($M_{ITE}$ and $M_{BTEx}$, x=1, 2) is given by the ratio between $H_{BTEx}$ and $H_{ITE}$. Similarly, the transfer functions from far-field sound source $S_{FF}$ to each of the microphones ($M_{ITE}$ and $M_{BTEx}$, x=1, 2) are denoted $A_{BTEx}$ and $A_{ITE}$, respectively. When the sound source $S_{FF}$ is far from the user (microphones), it is expected that the ratio between the transfer functions $A_{BTEx}$ and $A_{ITE}$ is smaller than the ratio between the feedback path transfer functions $H_{BTEx}$ and $H_{ITE}$, respectively, because the feedback path transfer functions are present in the acoustic near field, where the relative difference in the distance between the microphones $M_{ITE}$ and $M_{BTEx}$ to the speaker SPK ($S_{NF}$) is greater than the relative difference in the distance between the microphones $M_{ITE}$ and $M_{BTEx}$ to the far-field sound source $S_{FF}$, i.e., ($|A_{ITE}|/|A_{BTEx}|<(|H_{ITE}|/|H_{BTEx}|)$, as further discussed in EP2947898A1 (cf. section [0076] regarding FIG. 4).

The distance between the near field sound source $S_{NF}$ (the loudspeaker SPK) and the ITE-microphone $M_{ITE}$ may e.g. be of the order of 0.02 m. The distance between the near field sound source $S_{NF}$ (the loudspeaker SPK) and each of the BTE-microphones ($M_{BTEx}$, x=1, 2) may e.g. be of the order of 0.07 m. The difference in distance between the ITE and BTE microphones may e.g. be of the order of 0.05 m. The distance between the far-field sound source $S_{FF}$ (e.g. a communication partner) and the user (i.e. any of the microphones ($M_{ITE}$ and $M_{BTEx}$, x=1, 2)) may e.g. be of the order of 1 m or more.

Figure 5:
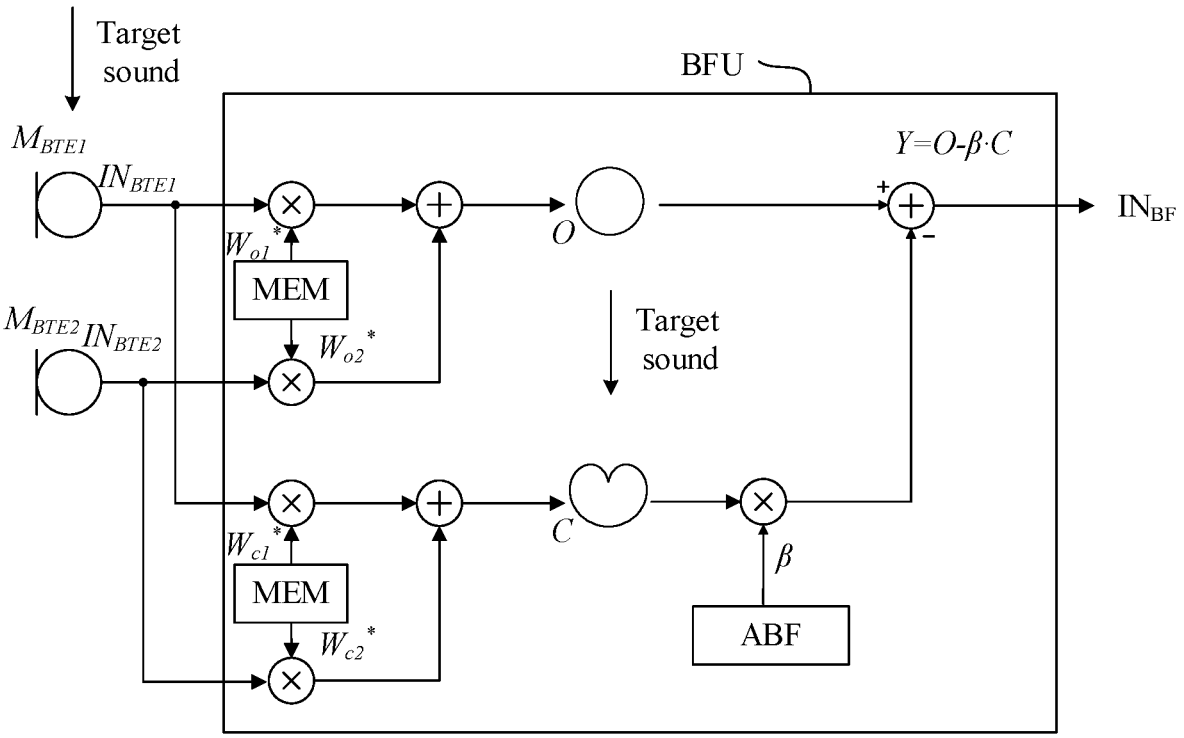
FIG. 5 shows an embodiment of a (far-field) beamformer filtering unit for use in a hearing device according to the present disclosure.

FIG. 5 shows an embodiment of a (far-field) beamformer filtering unit for use in a hearing device according to the present disclosure. An exemplary beamformer filtering unit (BFU) as indicated in FIGS. 2A and 2B is outlined in the following with reference to FIG. 5. FIG. 5 shows a part of a hearing aid comprising first and second microphones ($M_{BTE1}$, $M_{BTE2}$) providing respective first and second electric input signals $IN_{BTE1}$ and $IN_{BTE2}$, respectively and a beamformer filtering unit (BFU) providing a beamformed signal $IN_{BF}$ based on the first and second electric input signals. A direction from the target signal to the hearing aid is e.g. defined by the microphone axis and indicated in FIG. 5 by arrow denoted Target sound. The target direction can be any direction, e.g. a direction to the user's mouth (to pick up the user's own voice), or a direction to a communication partner in front of the user. An adaptive beam pattern (Y (Y(k))), for a given frequency band k, k being a frequency band index, is obtained by linearly combining an omnidirectional delay-and-sum-beamformer (O (O(k))) and a delay-and-subtract-beamformer (C (C(k))) in that frequency band. The adaptive beam pattern arises by scaling the delay-and-subtract-beamformer (C(k)) by a complex-valued, frequency-dependent, adaptive scaling factor β(k) (generated by beamformer ABF) before subtracting it from the delay-and-sum-beamformer (O(k)), i.e. providing the beam pattern Y, $$Y(k)=O(k)-\beta(k)C(k).$$

It should be noted that the sign in front of β(k) might as well be +, if the sign(s) of the weights constituting the delay-and-subtract beamformer C is/are appropriately adapted. Further, β(k) may be substituted by β*(k), where * denotes complex conjugate, such that the beamformed signal $IN_{BF}$ is expressed as $IN_{BF}=(w_o(k)-\beta(k)\cdot w_c(k))^H\cdot IN(k)$, where $IN(k)=(IN_{BTE1}(k), IN_{BTE2}(k))$.

A beamformer filtering unit of this nature is e.g. further described in EP2701145A1, and in EP3236672A1. Other kinds of beamformer filtering units may be used, though.

Figure 6A:
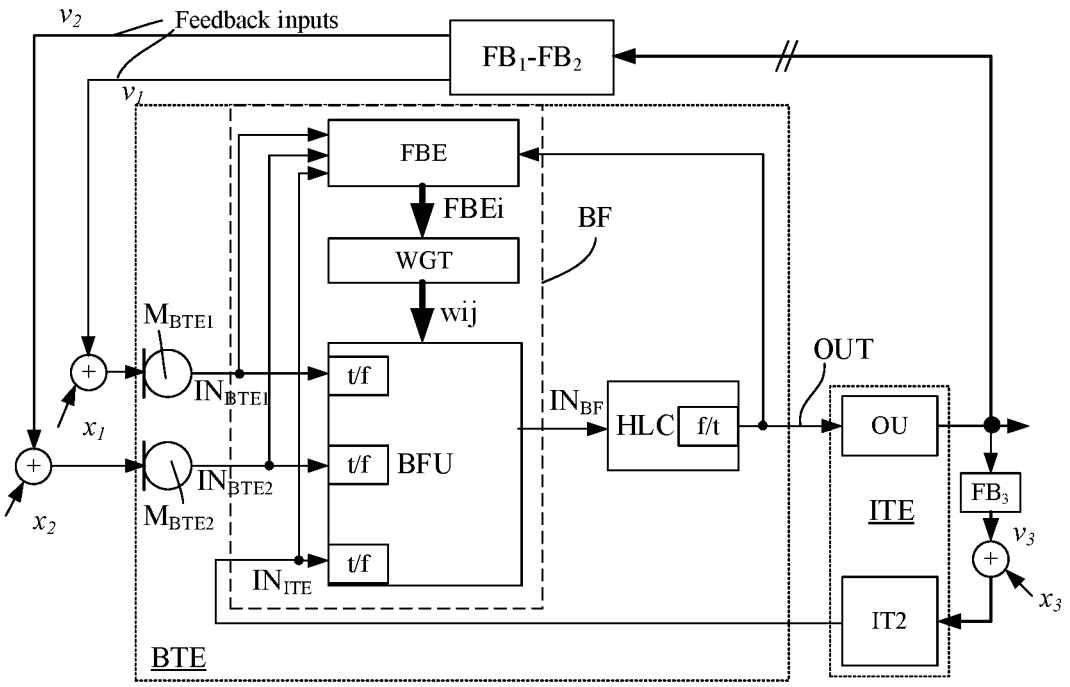
FIG. 6A shows a first embodiment of a hearing device comprising a far-field beamformer according to the present disclosure.

FIG. 6A shows a first embodiment of a hearing device (HD) comprising a far-field beamformer unit (BF) according to the second aspect of the present disclosure. The hearing device comprises a BTE-part and an ITE part adapted for being located at or behind pinna and at or in an ear canal, respectively, of a user. The BTE part comprises two input transducers (here microphones $M_{BTE1}$ and $M_{BTE2}$) providing respective (e.g. digitized) electric input signals $IN_{BTE1}$ and $IN_{BTE2}$ representing sound in the environment. The ITE-part comprises an input transducer (IT2), e.g. a microphone providing, (e.g. digitized) electric input signal $IN_{ITE}$ representing sound in the environment, and an output unit (OU), e.g. an output transducer, such as a loudspeaker, for providing output stimuli perceivable as sound to the user. The feedback path transfer functions FB1, FB2, FB3 from the output transducer to each of the input transducers ($M_{BTE1}$, $M_{BTE2}$, IT2, respectively) are indicated together with respective feedback signals $v_1$, $v_2$, $v_3$ and external signals $x_1$, $x_2$, $x_3$ at the location of the three input transducers. The BTE-part further comprises a beamformer unit (BF) receiving the three electric input signals $IN_{BTE1}$, $IN_{BTE2}$, and $IN_{ITE}$ representing sound in the environment and providing a beamformed signal $IN_{BF}$. The BTE-part further comprises a processor (HLC) for applying a processing algorithm to the beamformed signal, e.g. further noise reduction and/or compressive amplification, etc. and providing a processed electric output signal (OUT), which is fed to the output unit (OU) (in the ITE-part) for presentation to the user. The BTE- and ITE-part are electrically connected via a wired or wireless interface. The BTE-part (here the far-field beamformer filtering unit (BFU)) comprises respective analysis filter banks (t/f) for providing the electric input signals in the frequency domain (e.g. as a number of frequency sub-band signals, e.g. as a 'map' of consecutive time-frequency bins (m,k) where m and k are time frame and frequency indices, respectively. Thereby processing of signals can be performed in a time-frequency framework. Similarly, the hearing device, e.g. the BTE-part (and here the processor (HLC)) comprises a synthesis filter bank (t/f) for converting frequency sub-band signals to a time domain signal (OUT) before it is presented to the user via output unit (OU). The far-field beamformer unit (BF) further comprises feedback estimation unit (FBE) for providing estimates (indicated by bold arrow FBEi) of current feedback from the output unit (OU) to at least some (e.g. each) of the input transducers. The feedback estimation unit (FBE) receives the respective electric input signals ($IN_{BTE1}$, $IN_{BTE2}$, and $IN_{ITE}$) and the processed electric output signal (OUT) as inputs for determining the feedback estimates. The far-field beamformer unit (BF) further comprises weighting unit (WGT) for determining weights wij to be applied at a given point in time to the respective electric input signals to properly reflect the current mutual configuration (distances, locations) of ITE and BTE-microphones, cf. discussion above in relation to FIG. 4A. The weights are determined based on the frequency dependent feedback estimates FBEi, which are used to estimate phase (and possibly magnitude) differences between the ITE-microphone and the BTE-microphones (cf. e.g. FIGS. 7A, 7B), either adaptively or in advance of use of the hearing device (e.g. during a fitting session where the hearing device is adapted to the user in question).

Figure 6B:
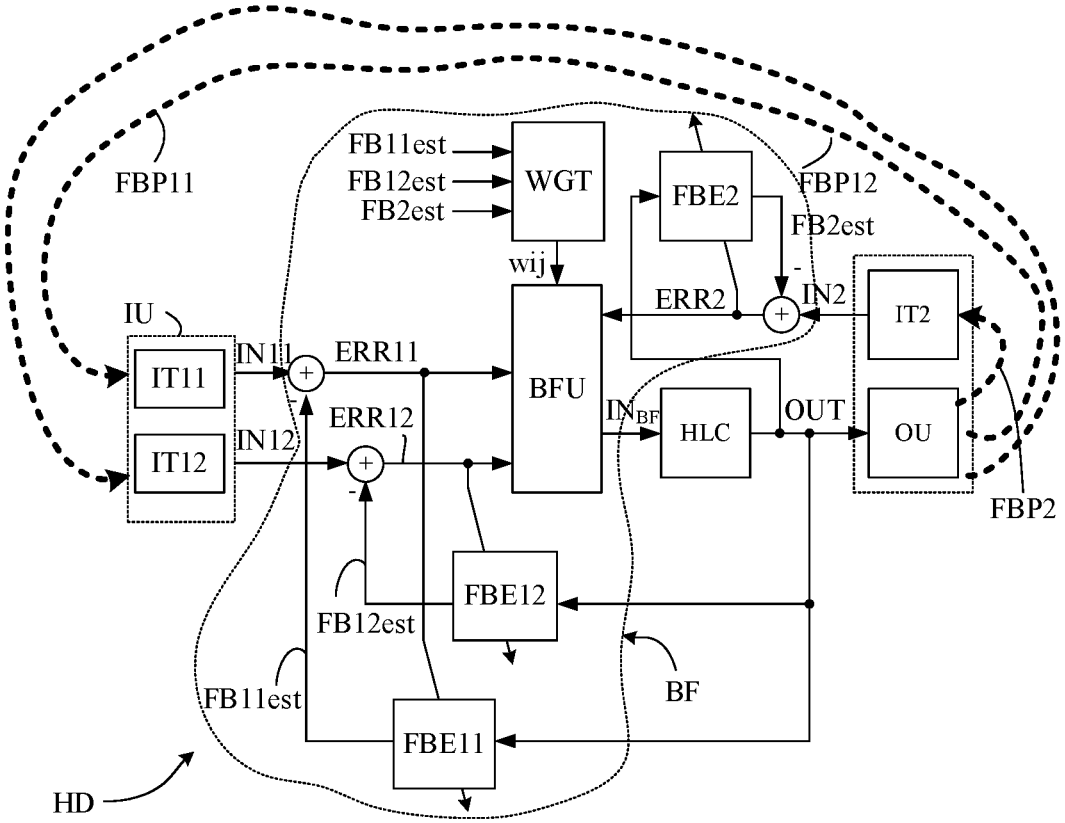
FIG. 6B shows a second embodiment of a hearing device comprising a far-field beamformer according to the present disclosure, and FIG. 7A schematically shows a difference in magnitude vs. frequency of a sound signal originating from the output transducer and arriving at the ITE and BTE-microphones, respectively, and FIG. 7B schematically shows a difference in phase vs. frequency of a sound signal originating from the output transducer and arriving at the ITE and BTE-microphones, respectively.

FIG. 6B shows a second embodiment of a hearing device (HD) comprising a far-field beamformer (BF) according to the second aspect of the present disclosure. The embodiment of FIG. 6B is similar to the embodiment of FIG. 6A, but the beamformer unit (BF) further comprises respective first second and third feedback estimation and cancellation systems (FBE11, FBE12, FBE2) for estimating the respective feedback paths (FB11est, FB12est, FB2est) from the output unit (OU) to each of the input transducers (IT11, IT12, IT2, respectively) and respective subtraction units ('+') for subtracting the feedback estimates from the respective electric input signals (IN11, IN12, IN2) before they are fed to the beamformer filtering unit (BFU) (cf. signals ERR11, ERR12, ERR2). Thereby the beamformed signal $IN_{BF}$ provided by the beamformer filtering unit (BF) is based on respective feedback corrected electric input signals (ERR11, ERR12, ERR2).

Figure 7A:
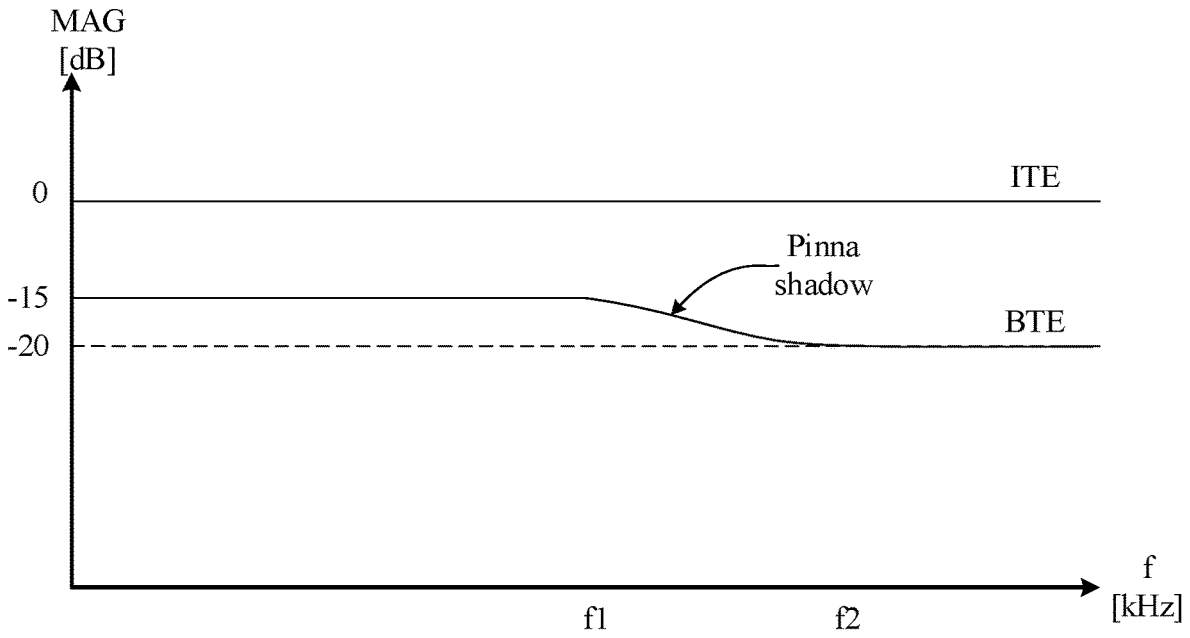
Figure 7B:
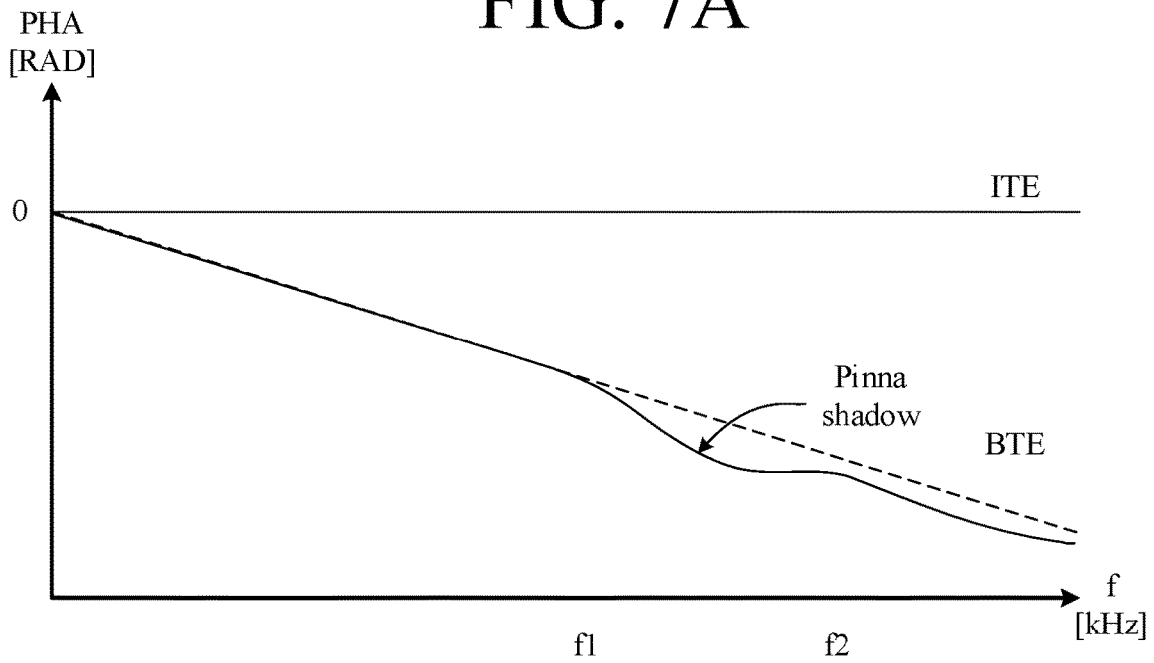

FIG. 7A shows a difference in magnitude MAG [dB] vs. frequency f [kHz] of a sound signal originating from the output transducer and arriving at the ITE and BTE-microphones, respectively, and FIG. 7B schematically shows a difference in phase PHA [RAD] vs. frequency f [kHz] of a sound signal originating from the output transducer and arriving at the ITE and BTE-microphones, respectively. The magnitude and phase differences are shown relative to the ITE-microphone and represented by the respective curves denoted BTE. FIGS. 7A and 7B illustrate the (shadowing) effect of pinna for propagation of sound from a sound source in the acoustic far-field (approximated by the difference in transfer of sound from an output transducer in the ear canal to each of the ITE and BTE-microphones, which can be derived from estimates of the respective feedback paths, cf. scenario of FIG. 4A). In the sketches of FIGS. 7A and 7B, it is indicated that the effect of pinna is largest between first and second intermediate frequencies f1 and f2, e.g. between two and five kHz (depending on the specific size and form of the ears of the user, hair style, clothing, and possible other 'wearables' (e.g. glasses). If the (frequency dependent) differences are adaptively estimated, possible predetermined microphone distances (delay (phase), attenuation (magnitude)) can be (repeatedly) updated (e.g. at each power up of the hearing device, or more frequently, possibly initiated via a user interface) to improve the performance of the far-field beamformer filtering unit (BFU) according to the first and/or second aspect of the present disclosure. In an embodiment, only the phase difference is estimated.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

EP2849462A1 (OTICON) Mar. 18, 2015
EP2843971A1 (OTICON) Mar. 4, 2015
EP2701145A1 (RETUNE DSP, OTICON) Apr. 26, 2014
EP3236672A1 (OTICON) Oct. 25, 2017
EP2947898A1 (OTICON) Nov. 25, 2015
EP3185589A1 (OTICON) Jun. 28, 2017

The invention claimed is:

1. A hearing device configured to be worn by a user, the hearing device comprising two or more input transducers or two microphones, where said two or more input transducers or two microphones, during use of the hearing device, are arranged with a distance between them; and a directional system comprising a directional algorithm configured to provide a directional pattern in dependence of said distance, wherein the hearing device is configured to estimate a current value of said distance, or an equivalent acoustic delay, or beamformer weights of said directional system by measuring a phase difference between signals detected by the two or more input transducers or the two microphones and originating from a sound outlet, and wherein the phase difference is estimated in dependence on an estimated feedback path from said sound outlet to said two or more input transductors or said two microphones.

2. A hearing device according to claim 1, wherein the estimated feedback path is estimated by a loop gain estimation algorithm and a signal needed to estimate the loop gain comprises one or more pure tones or broadband noise.

3. A hearing device according to claim 2, wherein said estimate of the loop gain is provided in real time, in order to adaptively compensate for varying microphone distances during wear of the hearing device.

4. A hearing device according to claim 1, wherein the directional system provides a directional pattern designed to emphasize sound from one direction and to suppress sound from other directions.

5. A hearing device according to claim 4, wherein the directional pattern has a cancellation angle, or more cancellation angles, in the rear region that is dependent of the microphone distance.

6. A hearing according to claim 1, wherein said two or more input transducers or said two microphones includes one microphone located in or at an earpiece and another located elsewhere on the body.

7. A hearing device according to claim 1, further comprising a BTE-part adapted to be worn at or behind an ear of a user, and an ITE-part adapted to be located at or in an ear canal of the user, and wherein at least one input transducer is located in the BTE-part, wherein another input transducer is located in the ITE-part.

8. A hearing device according to claim 1, wherein said distance is an acoustical microphone distance seen from an external sound field.

9. A hearing device according to claim 1, further comprising a time to time-frequency conversion unit allowing the processing of signals in the time-frequency domain.

10. A hearing device according to claim 1, wherein said distance or an equivalent acoustic delay is used to optimize the directional algorithm, a delay and sum algorithm or an MVDR algorithm, for the individual user of the hearing device.

11. A hearing device according to claim 1 being constituted by or comprising a hearing aid, a headset, or an active ear protection device or a combination thereof.

12. A method of operating a hearing device, the hearing device being configured to be worn by a user, the hearing device comprising two or more input transducers, where said two or more input transducers, during use of the hearing device, are arranged with a distance between them, the method comprising:

estimating a current value of said distance, or an equivalent acoustic delay, or beamformer weights of a directional system;

estimating a phase difference between signals detected by the two or more input transducer or two microphones and sound originating from a sound outlet in dependence on an estimated feedback path from the sound outlet to said two or more input transducers or said two microphones; and providing a directional pattern in dependence of said distance.

* * * * *